US006870512B2

(12) United States Patent
Yoneda et al.

(10) Patent No.: US 6,870,512 B2
(45) Date of Patent: Mar. 22, 2005

(54) ANTENNA DEVICE FOR CONDUCTING TWO-AXIAL SCANNING OF AN AZIMUTH AND ELEVATION

(75) Inventors: Naofumi Yoneda, Tokyo (JP); Moriyasu Miyazaki, Tokyo (JP); Izuru Naitoh, Tokyo (JP); Yoshio Inasawa, Tokyo (JP); Shigeru Makino, Tokyo (JP); Shuji Urasaki, Tokyo (JP); Yoshihiko Konishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/258,394

(22) PCT Filed: Jul. 18, 2001

(86) PCT No.: PCT/JP01/06237

§ 371 (c)(1),
(2), (4) Date: Oct. 24, 2002

(87) PCT Pub. No.: WO02/071539

PCT Pub. Date: Sep. 12, 2002

(65) Prior Publication Data

US 2003/0137466 A1 Jul. 24, 2003

(30) Foreign Application Priority Data

Mar. 2, 2001 (JP) ..... 2001-58821

(51) Int. Cl.[7] ..... H01Q 13/00

(52) U.S. Cl. ..... 343/781 CA; 343/757; 343/762; 343/763; 343/781 P

(58) Field of Search ..... 343/754, 755, 343/761, 762, 763, 766, 781 CA, 781 P, 757, 765

(56) References Cited

U.S. PATENT DOCUMENTS 3,618,091 A * 11/1971 Butler ..... 342/149
3,987,451 A * 10/1976 Peterson ..... 343/765
4,120,085 A * 10/1978 Peterson ..... 29/600
4,185,287 A * 1/1980 Hubing et al. ..... 343/761
4,338,607 A * 7/1982 Drabowitch ..... 343/754
6,204,822 B1 * 3/2001 Cardiasmenos et al. .... 343/761

FOREIGN PATENT DOCUMENTS

| | | |
|---|---|---|
| JP | 60-030613 U | 3/1985 |
| JP | 01-227502 A | 9/1989 |
| JP | 02-134716 U | 11/1990 |
| JP | 11-017402 A | 1/1999 |
| JP | 11-186827 A | 7/1999 |
| JP | 11-289208 A | 10/1999 |

OTHER PUBLICATIONS

Kitsuregawa, Electrical and Mechanical Design, pp. 232–235 (1990).

Aoki et al., IEE Proc–Microw, Antenna Propag., vol. 146, No. 1 pp. 60–64 (1999).

Wakana et al., Proceeding of ISAP, pp. 497–500 (2000).

* cited by examiner

*Primary Examiner*—Tho Phan
(74) *Attorney, Agent, or Firm*—Birch, Stewart, Kolasch & Birch, LLP

(57) ABSTRACT

For the purpose of obtaining a mechanical drive reflecting mirror antenna device which is downsized and low in attitude, enables wide-angle scanning, and is high in performance, there are provided a main reflection mirror 1, a sub-reflection mirror 2, a primary radiator 3, a first circular waveguide 4 which is connected to the primary radiator and has a plurality of bend portions, a first circular waveguide rotary joint 5 which is connected to the first circular waveguide, a second circular waveguide 7 which is connected to the first circular waveguide rotary joint and has a plurality of bend portions, and a second circular waveguide rotary joint 8 which is connected to the second circular waveguide and is different in a direction of a rotary axis from the first circular waveguide rotary joint by substantially 90 degrees.

31 Claims, 16 Drawing Sheets

(a)

(b)

(a)

(b)

ANTENNA DEVICE FOR CONDUCTING TWO-AXIAL SCANNING OF AN AZIMUTH AND ELEVATION

This application is the national phase under 35 U.S.C. §371 of PCT International Application No. PCT/JP01/06237 which has an International filing date of Jul. 18, 2001, which designated the United States of America.

TECHNICAL FIELD

The present invention relates to a mechanical drive reflecting mirror antenna device that conducts two-axial scanning of an azimuth and elevation mainly used in a VHF band, a UHF band, a micro-wave band and an extremely-high frequency band.

BACKGROUND ART

FIG. 28 is a schematic structural view showing a reflecting mirror antenna device that conducts the mechanical drive scanning with respect to rotary axes in an azimuth direction and an elevation direction disclosed in, for example, Takashi Kitsuregawa, "Advanced Technology in Satellite Communication Antennas: Electrical & Mechanical Design", ARTECH HOUSE INC., pp.232–235, 1990.

Referring to FIG. 28, reference numeral 61 denotes a main reflection mirror; 62 is a sub-reflection mirror; 63 is a primary radiator; 64 is a circularly polarized wave generator; 65 is a polarization divider; 66 is a receiver; 67 is an elevation shaft rotary joint; 68 is an azimuth shaft rotary joint; 69 is a transmitter; 70 is an elevation shaft rotary mechanism; and 71 is an azimuth shaft rotary mechanism.

Subsequently, an operation will be described. A signal outputted from the transmitter 69 is inputted to the polarization divider 65 through the rotary joints 68 and 67, and thereafter transformed into a circularly polarized wave from a linearly polarized wave by the circularly polarized wave generator 64 and then radiated into air through the primary radiator 63 and the sub-reflection mirror 62 by the main reflection mirror 61. Also, an electric wave received by the main reflection mirror 61 is transformed into the linearly polarized wave from the circularly polarized wave through the sub-reflection mirror 62 and the primary radiator 63 by the circularly polarized wave generator 64, inputted to the polarization divider 65 and thereafter enters the receiver 66.

Because the main reflection mirror 61, the sub-reflection mirror 62, the primary radiator 63, the circularly polarized wave generator 64 and the polarization divider 65 can be driven within a wide angular range by the rotary mechanisms 70, 71 and the rotary joints 67, 68 without deteriorating the electric characteristics, an antenna beam can be transmitted while scanning over a wide angle. Also, because the main reflection mirror 61, the sub-reflection mirror 62, the primary radiator 63, the circularly polarized wave generator 64, the polarization divider 65 and the receiver 66 can be driven integrally within a wide angular range by the rotary mechanisms 70 and 71, they can receive an electric wave coming from the wide angular range.

In a conventional antenna device, because the circularly polarized wave generator 64, the polarization divider 65 and the receiver 66 are located on the rotary joints 67, 68 and the rotary mechanisms 70, 71, and those circuits, the main reflection mirror 61, the sub-reflection mirror 62 and the primary radiator 63 are rotated integrally, there arises such a problem that the height of the antenna device from the azimuth shaft rotary mechanism 71 increases and it is difficult to downsize the antenna device and to make the attitude of the antenna device low.

The present invention has been made to solve the above-mentioned problems, and therefore an object of the present invention is to obtain a mechanical drive reflecting mirror antenna device that enables the downsizing, the low attitude and wide-angle scanning and is high in performance.

DISCLOSURE OF THE INVENTION

In order to attain the above-mentioned object, an antenna device according to the present invention is characterized by comprising: a plurality of reflecting mirrors; one primary radiator; a first circular waveguide which is connected to the primary radiator and has a plurality of bend portions; a first circular waveguide rotary joint which is connected to the first circular waveguide; a second circular waveguide which is connected to the first circular waveguide rotary joint and has a plurality of bend portions; and a second circular waveguide rotary joint which is connected to the second circular waveguide and is different in a direction of a rotary axis from the first circular waveguide rotary joint by substantially 90 degrees.

Also, an antenna device according to the present invention is characterized by comprising: a plurality of reflecting mirrors; one primary radiator; a first square waveguide which is connected to the primary radiator and has a plurality of bend portions; a first square-circle waveguide transforming portion which is connected to the first square waveguide; a first circular waveguide rotary joint which is connected to the first square-circle waveguide transforming portion; a second square-circle waveguide transforming portion which is connected to the first circular waveguide rotary joint; a second square waveguide which is connected to the second square-circle waveguide transforming portion and has a plurality of bend portions; a third square-circle waveguide transforming portion which is connected to the second square waveguide; and a second circular waveguide rotary joint which is connected to the third square-circle waveguide transforming portion and is different in a direction of a rotary axis from the first circular waveguide rotary joint by substantially 90 degrees.

Also, it is characterized in that square-circle waveguide multi-step transformers are used as the first to third square-circle waveguide transforming portions.

Also, it is characterized in that square-circle waveguide tapers are used as the first to third square-circle waveguide transforming portions.

Also, an antenna device according to the present invention is characterized by comprising: a plurality of reflecting mirrors; one primary radiator; a first orthogonal polarization diplexer which is connected to the primary radiator; a first rectangular waveguide which is connected to the first orthogonal polarization diplexer; a second rectangular waveguide which is connected to the first orthogonal polarization diplexer; a second orthogonal polarization diplexer which is connected to the first and second rectangular waveguides; a first circular waveguide rotary joint which is connected to the second orthogonal polarization diplexer; a third orthogonal polarization diplexer which is connected to the first circular waveguide rotary joint; a third rectangular waveguide which is connected to the third orthogonal polarization diplexer; a fourth rectangular waveguide which is connected to the third orthogonal polarization diplexer; a fourth orthogonal polarization diplexer which is connected to the third and fourth rectangular waveguides; and a second circular waveguide rotary joint which is connected to the fourth orthogonal polarization diplexer and is different in a direction of the rotary axis from the first circular waveguide rotary joint by substantially 90 degrees.

Also, it is characterized in that the first and second rectangular waveguides are wired in parallel with the same configuration, and the third and fourth rectangular waveguides are wired in parallel with the same configuration.

Also, an antenna device according to the present invention is characterized by comprising: a plurality of reflecting mirrors; first and second primary radiators; a first orthogonal polarization diplexer which is connected to the first primary radiator; a first rectangular waveguide which is connected to the first orthogonal polarization diplexer; a second rectangular waveguide which is connected to the first orthogonal polarization diplexer; a second orthogonal polarization diplexer which is connected to the first and second rectangular waveguides; a first circular waveguide rotary joint which is connected to the second orthogonal polarization diplexer; a third orthogonal polarization diplexer which is connected to the first circular waveguide rotary joint; a third rectangular waveguide which is connected to the third orthogonal polarization diplexer; a fourth rectangular waveguide which is connected to the third orthogonal polarization diplexer; a fourth orthogonal polarization diplexer which is connected to the second primary radiator; a fifth rectangular waveguide which is connected to the fourth orthogonal polarization diplexer; a sixth rectangular waveguide which is connected to the fourth orthogonal polarization diplexer; a fifth orthogonal polarization diplexer which is connected to the fifth and sixth rectangular waveguides; a second circular waveguide rotary joint which is connected to the fifth orthogonal polarization diplexer; a sixth orthogonal polarization diplexer which is connected to the second circular waveguide rotary joint; a seventh rectangular waveguide which is connected to the sixth orthogonal polarization diplexer; an eighth rectangular waveguide which is connected to the sixth orthogonal polarization diplexer; a first waveguide T-junction which is connected to the third and seventh rectangular waveguides; a second waveguide T-junction which is connected to the fourth and eighth rectangular waveguides; a seventh orthogonal polarization diplexer which is connected to the first and second waveguide T-junctions; and a third circular waveguide rotary joint which is connected to the seventh orthogonal polarization diplexer.

Also, it is characterized in that the first and second rectangular waveguides are wired in parallel with the same configuration, the third and fourth rectangular waveguides are wired in parallel with the same configuration, the fifth and sixth rectangular waveguides are wired in parallel with the same configuration, the seventh and eighth rectangular waveguides are wired in parallel with the same configuration, and the first and second waveguide T-junctions are arranged in parallel with the same configuration.

Also, an antenna device according to the present invention is characterized by comprising: a plurality of reflecting mirrors; first and second primary radiators; a first circular waveguide rotary joint which is connected to the first primary radiator; a first orthogonal polarization diplexer which is connected to the first circular waveguide rotary joint; a second circular waveguide rotary joint which is connected to the second primary radiator; a second orthogonal polarization diplexer which is connected to the second circular waveguide rotary joint; a first waveguide T-junction which is connected to the first and second orthogonal polarization diplexer; a second waveguide T-junction which is connected to the first and second orthogonal polarization diplexers; a third orthogonal polarization diplexers which is connected to the first and second waveguide T-junctions; and a third circular waveguide rotary joint which is connected to the third orthogonal polarization diplexer.

Also, an antenna device according to the present invention is characterized by comprising: a plurality of reflecting mirrors; first and second primary radiators; a first orthogonal polarization diplexer which is connected to the first primary radiator; a second orthogonal polarization diplexer which is connected to the second primary radiator; a first waveguide T-junction which is connected to the first and second orthogonal polarization diplexers; a second waveguide T-junction which is connected to the first and second orthogonal polarization diplexers; a third orthogonal polarization diplexer which is connected to the first and second waveguide T-junctions; and a circular waveguide rotary joint which is connected to the third orthogonal polarization diplexer.

Also, an antenna device according to the present invention is characterized by comprising: a plurality of reflecting mirrors; first and second primary radiators; a first circular waveguide bend which is connected to the first primary radiator; a first circular waveguide rotary joint which is connected to the first circular waveguide bend; a first orthogonal polarization diplexer which is connected to the first circular waveguide rotary joint; a second circular waveguide bend which is connected to the second primary radiator; a second circular waveguide rotary joint which is connected to the second circular waveguide bend; a second orthogonal polarization diplexer which is connected to the second circular waveguide rotary joint; a first waveguide T-junction which is connected to the first and second orthogonal polarization diplexers; a second waveguide T-junction which is connected to the first and second orthogonal polarization diplexers; a third orthogonal polarization diplexer which is connected to the first and second waveguide T-junctions; and a third circular waveguide rotary joint which is connected to the third orthogonal polarization diplexer.

Also, it is characterized in that the first and second waveguide T-junctions are arranged in parallel with the same configuration.

Also, it is characterized in that the first circular waveguide rotary joint and the second circular waveguide rotary joint are so arranged as to have the same rotary axis, and the third circular waveguide rotary joint is different in a direction of the rotary axis from the first and second circular waveguide rotary joints by substantially 90 degrees.

Also, an antenna device according to the present invention is characterized by comprising: a plurality of reflecting mirrors; first to fourth primary radiators; a first circular waveguide rotary joint which is connected to the first primary radiator; a first orthogonal polarization diplexer which is connected to the first circular waveguide rotary joint; a second circular waveguide rotary joint which is connected to the second primary radiator; a second orthogonal polarization diplexer which is connected to the second circular waveguide rotary joint; a first waveguide T-branching circuit which is connected to the first and second orthogonal polarization diplexers; a second waveguide T-branching circuit which is connected to the first and second orthogonal polarization diplexers; a third circular waveguide rotary joint which is connected to the third primary radiator; a third orthogonal polarization diplexer which is connected to the third circular waveguide rotary joint; a fourth circular waveguide rotary joint which is connected to the fourth primary radiator; a fourth orthogonal polarization diplexer which is connected to the fourth circular waveguide rotary joint; a third waveguide T-branching circuit which is connected to the third and fourth orthogonal polarization diplexers; a fourth waveguide T-junction which is connected to the third and fourth orthogonal polarization diplexers; a first rectangular waveguide which is connected to the first waveguide T-junction; a second rectangular waveguide which is connected to the second waveguide T-junction; a third rectangular waveguide which is connected to the third waveguide T-junction; a fourth rectangular waveguide which is connected to the fourth waveguide T-junction; a fifth waveguide T-junction which is connected to the first and third rectangular waveguides; a sixth waveguide T-junction which is connected to the second and fourth rectangular waveguides; a fifth orthogonal polarization diplexer which is connected to the fifth and sixth waveguide T-junctions; and a fifth circular waveguide rotary joint which is connected to the fifth orthogonal polarization diplexer.

Also, an antenna device according to the present invention is characterized by comprising: a plurality of reflecting mirrors; first to fourth primary radiators; a first orthogonal polarization diplexer which is connected to the first primary radiator; a second orthogonal polarization diplexer which is connected to the second primary radiator; a first waveguide T-junction which is connected to the first and second orthogonal polarization diplexers; a second waveguide T-junction which is connected to the first and second orthogonal polarization diplexers; a third orthogonal polarization diplexer which is connected to the third primary radiator; a fourth orthogonal polarization diplexer which is connected to the fourth primary radiator; a third waveguide T-junction which is connected to the third and fourth orthogonal polarization diplexers; a fourth waveguide T-junction which is connected to the third and fourth orthogonal polarization diplexers; a first rectangular waveguide which is connected to the first waveguide T-junction a second rectangular waveguide which is connected to the second waveguide T-junction; a third rectangular waveguide which is connected to the third waveguide T-junction; a fourth rectangular waveguide which is connected to the fourth waveguide T-junction; a fifth waveguide T-junction which is connected to the first and third rectangular waveguides; a sixth waveguide T-junction which is connected to the second and fourth rectangular waveguides; a fifth orthogonal polarization diplexer which is connected to the fifth and sixth waveguide T-junctions; and a circular waveguide rotary joint which is connected to the fifth orthogonal polarization diplexer.

Also, an antenna device according to the present invention is characterized by comprising: a plurality of reflecting mirrors; first to fourth primary radiators; a first circular waveguide bend which is connected to the first primary radiator; a first circular waveguide rotary joint which is connected to the first circular waveguide bend; a first orthogonal polarization diplexer which is connected to the first circular waveguide rotary joint; a second circular waveguide bend which is connected to the second primary radiator; a second circular waveguide rotary joint which is connected to the second circular waveguide bend; a second orthogonal polarization diplexer which is connected to the second circular waveguide rotary joint; a first waveguide T-junction which is connected to the first and second orthogonal polarization diplexers; a second waveguide T-branching circuit which is connected to the first and second orthogonal polarization diplexers; a third circular waveguide bend which is connected to the third primary radiator; a third circular waveguide rotary joint which is connected to the third circular waveguide bend; a third orthogonal polarization diplexer which is connected to the third circular waveguide rotary joint; a fourth circular waveguide bend which is connected to the fourth primary radiator; a fourth circular waveguide rotary joint which is connected to the fourth circular waveguide bend; a fourth orthogonal polarization diplexer which is connected to the fourth circular waveguide rotary joint; a third waveguide T-branching circuit which is connected to the third and fourth orthogonal polarization diplexers; a fourth waveguide T-branching circuit which is connected to the third and fourth orthogonal polarization diplexers; a first rectangular waveguide which is connected to the first waveguide T-junction; a second rectangular waveguide which is connected to the second waveguide T-junction; a third rectangular waveguide which is connected to the third waveguide T-junction; a fourth rectangular waveguide which is connected to the fourth waveguide T-junction; a fifth waveguide T-junction which is connected to the first and third rectangular waveguides; a sixth waveguide T-junction which is connected to the second and fourth rectangular waveguides; a fifth orthogonal polarization diplexer which is connected to the fifth and sixth waveguide T-junctions; and a fifth circular waveguide rotary joint which is connected to the fifth orthogonal polarization diplexer.

Also, it is characterized in that the first and second rectangular waveguides are wired in parallel with the same configuration, the third and fourth rectangular waveguides are wired in parallel with the same configuration, the first and second waveguide T-junctions are arranged in parallel with the same configuration, the third and fourth waveguide T-junctions are arranged in parallel with the same configuration, and the fifth and sixth waveguide T-junctions are arranged in parallel with the same configuration.

Also, it is characterized in that the first to fourth circular waveguide rotary joints are so arranged as to have the same rotary axis, and the fifth circular waveguide rotary joint is different in a direction of the rotary axis from the first to fourth circular waveguide rotary joints by substantially 90 degrees.

Also, it is characterized in that a septum type polarizer is used as the orthogonal polarization diplexer.

Also, it is characterized in that an orthomode transducer is used as the orthogonal polarization diplexer.

Also, the antenna device according to the present invention is characterized by further comprising: a waveguide orthomode transducer which is connected to the circular waveguide rotary joint and has first to fourth branching waveguides; a first waveguide diplexer which is connected to the first and third branching waveguides of the polarization divider; a second waveguide diplexer which is connected to the second and fourth branching waveguides of the polarization divider; a first low-noise amplifier which is connected to the first waveguide diplexer; a second low-noise amplifier which is connected to the second waveguide diplexer; a first 90-degree hybrid circuit which is connected to the first and second low-noise amplifiers; a second 90-degree hybrid circuit which is connected to the first and second waveguide diplexers; a first high-power amplifier which is connected to the second 90-degree hybrid circuit; a first variable phase shifter which is connected to the first high-power amplifier; a second high-power amplifier which is connected to the second 90-degree hybrid circuit; a second variable phase shifter which is connected to the second high-power amplifier; and a third 90-degree hybrid circuit which is connected to the first and second variable phase shifters.

Also, the antenna device according to the present invention further comprises a rotary mechanism that rotates the plurality of reflecting mirrors about an azimuth shaft and an elevation shaft which are orthogonal to each other, the device being characterized in that each of the plurality of reflecting mirrors has a substantially rectangular opening which is slender in a direction of the elevation shaft, and is subjected to a mirror surface adjustment so as to receive and reflect substantially all of electromagnetic waves supplied from the primary radiators so that an antenna height is prevented from becoming high even when the plurality of reflecting mirrors rotate about the elevation shaft.

BEST MODE FOR CARRYING OUT THE INVENTION

First Embodiment

Figure 1:
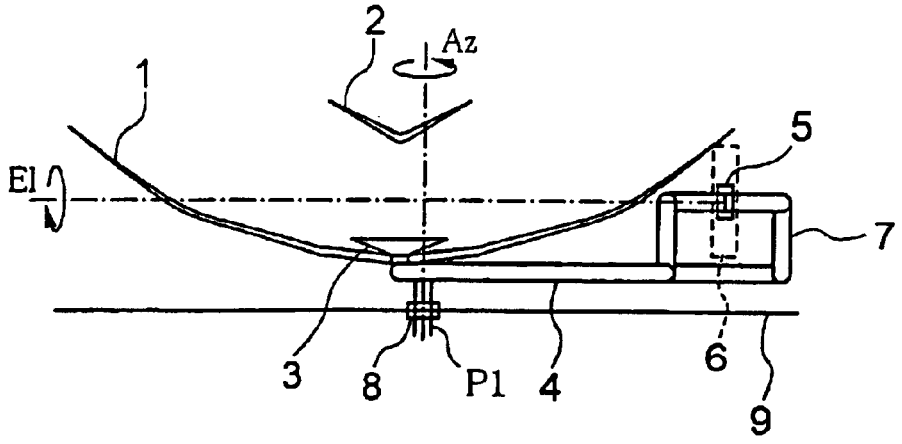
FIG. 1 are a side view and a top view showing an antenna device in accordance with a first embodiment of the present invention.
Figure 1:
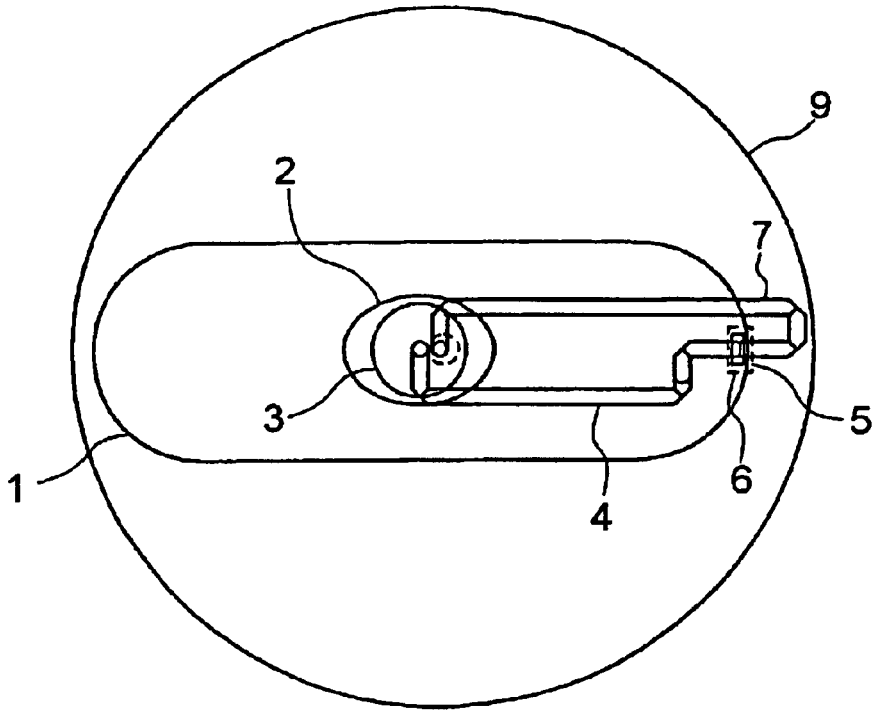

FIGS. 1(*a*) and 1(*b*) are a side view and a top view showing a mechanical drive reflecting mirror antenna device in accordance with a first embodiment of the present invention.

Referring to FIG. 1, reference numeral 1 denotes a main reflection mirror; 2 is a sub-reflection mirror; 3 is a primary radiator; 4 is a circular waveguide; 5 is a circular waveguide rotary joint; 6 is an elevation shaft rotary mechanism; 7 is a circular waveguide; 8 is a circular waveguide rotary joint; 9 is an azimuth shaft rotary mechanism; and P1 is an input/output terminal. Also, a reference symbol Az denotes an azimuth rotary direction and a reference symbol E1 denotes an elevation rotary direction.

In this example, a tubular axis of the circular waveguide rotary joint 5 is on a horizontal plane that divides the height of a portion of the antenna device upper than the azimuth shaft rotary mechanism 9 into substantially two equal parts. Also, the circular waveguides 4 and 7 have three bend portions that are bent at 90 degrees on a vertical plane and three bend portions that are bent at 90 degrees on a horizontal plane. In addition, the main reflection mirror 1 and the primary radiator 3 are so located as to be directed upwardly, and the sub-reflection mirror 2 is so located as to be directed downwardly.

Subsequently, the operation will be described. Assuming that an electric wave R1 of a right-handed circularly polarized wave of a circular waveguide TE11 mode (basic mode)

is inputted from a terminal P1, the electric wave R1 is propagated through the rotary joint 8, the circular waveguide 7, the rotary joint 5 and the circular waveguide 4 and then radiated from the main reflection mirror 1 through the primary radiator 3 and the sub-reflection mirror 2 toward the air as the right-handed circularly polarized wave.

In addition, because the electric wave R1 of the circularly polarized wave is different in transmission and reflection characteristics between a case in which an electric field is perpendicular to a bent surface on the respective bend portions of 90 degrees and a case in which the electric field is horizontal thereto when being propagated through the circular waveguide 7, the electric wave R1 becomes an elliptically polarized wave. However, because the circular waveguide 7 is wired with the provision of the same number of bend portions bent at 90 degrees on the vertical plane and bend portions bent at 90 degrees on the horizontal plane, the electric wave R1 that becomes the elliptically polarized wave halfway is finally corrected to the circularly polarized wave at a position where the electric wave R1 is emitted from the circular waveguide 7. The same is applied to the propagation of the electric wave R1 through the circular waveguide 4.

Also, since the rotary joints 8 and 5 are structured with the circular waveguide TE11 mode as the propagation mode, the rotary joints 8 and 5 can be driven over a wide angular range without deteriorating the electric characteristic, thereby being capable of transmitting the antenna beam while scanning the antenna beam over a wide angle. Also, the excellent transmission and reflection characteristics can be expected over the wide band.

The above-mentioned operational principle is applied at the time of transmitting the right-handed circularly polarized wave. However, the same is applied to the time of receiving the right-handed circularly polarized wave. Also, the same is applied to a case of transmitting and receiving a left-handed circularly polarized wave.

As described above, according to the first embodiment shown in FIG. 1, because the antenna portion and the rotary joint portion are connected to each other by the circular waveguides 4 and 7 that have a plurality of 90-degree bendings and compensate the circularly polarized wave characteristic, the height of a portion of the antenna device upper than the azimuth shaft rotary mechanism 9 can be appropriately reduced without deteriorating the electric characteristic, and there can be obtained a mechanical drive reflecting mirror antenna device that enables the downsizing, the low attitude and wide-angle scanning and is high in performance.

Subsequently, an example in which the main reflection mirror 1 structured as shown in FIG. 1 is supported by a support structure 53 in a state where the main reflection mirror 1 is axially arranged apart from the sub-reflection mirror 2 will be described with reference to FIG. 2.

Figure 2:
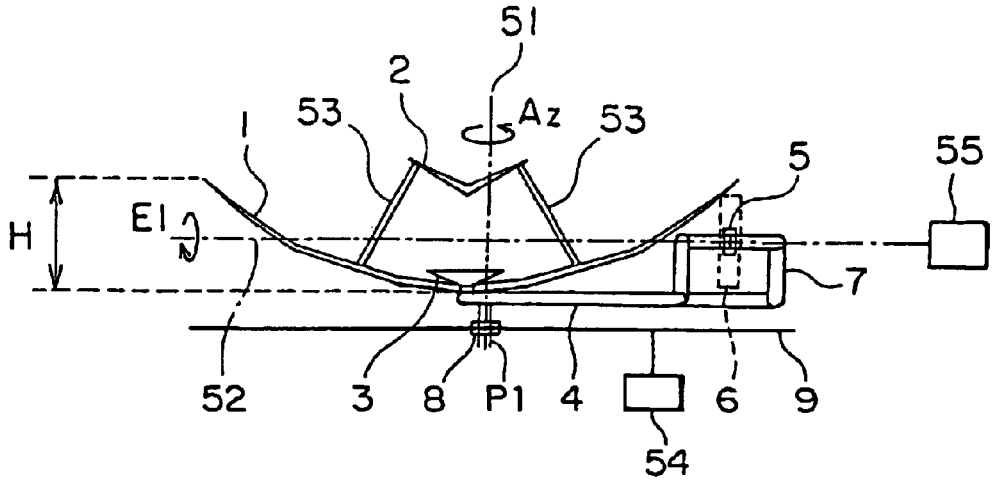
FIG. 2 are a side view and a top view showing the antenna device corresponding to FIG. 1, in which a main reflection mirror is supported by a support structure in a state where the main reflection mirror is axially arranged apart from a sub-reflection mirror.
Figure 2:
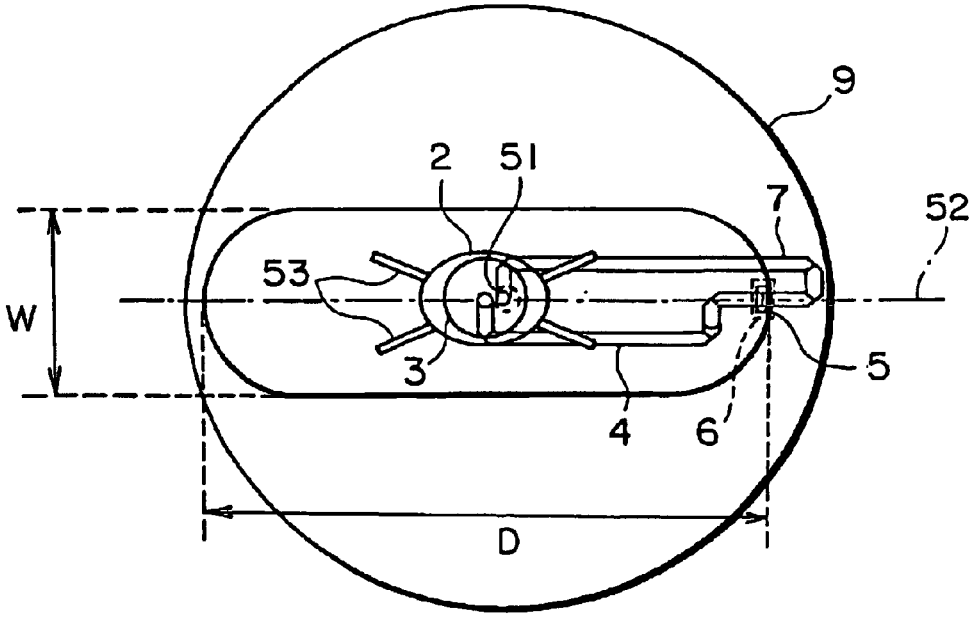

FIGS. 2(*a*) and 2(*b*) are a side view and a top view showing the mechanical drive reflecting mirror antenna device corresponding to FIGS. 1(*a*) and 1(*b*), respectively.

Referring to FIG. 2, the same parts as those in FIG. 1 are denoted by like reference symbols and their description will be omitted. As new reference symbols, reference numeral 51 denotes an azimuth shaft; 52 is an elevation shaft; 53 is a support mechanism; 54 is an azimuth shaft rotary driving source; 55 is an elevation shaft rotary driving source; and P1 is an input/output terminal. Reference symbol Az denotes an azimuth rotary direction, and a reference symbol E1 denotes an elevation rotary direction.

The operation is the same as that of the example shown in FIG. 1, and in FIG. 2, only characteristic points will be described.

The main reflection mirror 1 and the sub-reflection mirror 2 are so supported as to rotate about the elevation shaft 52 by the elevation shaft rotary mechanism 6 and are caused to rotate by the elevation shaft rotary driving source 55. The circular waveguide 4 connected to the primary radiator 3 is connected to the first circular waveguide rotary joint 5 at a position on the elevation shaft 52 so as not to prevent the rotations of the main reflection mirror 1 and the sub-reflection mirror 2.

The main reflection mirror 1 thus supported so as to rotate about the elevation shaft 52 is also so designed as to rotate the azimuth shaft 51 in combination with the azimuth shaft rotary mechanism 9 by the rotary driving source 54. The second circular waveguide rotary joint 8 is disposed at the rotary center of the rotary mechanism 9 between the circular waveguide 7 and the input/output terminal P1, and at that portion, the rotary mechanism 9, and the main reflection mirror 1 and the sub-reflection mirror 2 on the rotary mechanism are permitted to rotate about the azimuth shaft 51.

The main reflection mirror 1 is an antenna that has a substantially rectangular opening having the dimension as a whole of a length D (refer to FIG. 2(*b*)) in a direction of the elevation shaft 3 and the dimension of a width W (refer to FIG. 2(*b*)) in a direction perpendicular to the elevation shaft 3. Also, the sub-reflection mirror 2 is also an antenna having a substantially rectangular opening. The elevation shaft 52 is an axis that passes through the substantially center position of the distance (height) H in the azimuth shaft 51 direction (height direction) of the main reflection mirror 1 (refer to FIG. 2(*a*)) and passes through the substantially center position in a direction (widthwise direction) W perpendicular to the elevation shaft 52 (refer to FIG. 2(*b*)).

Therefore, when the main reflection mirror 1 and the sub-reflection mirror 2 are rotated about the elevation shaft 52, a range where the main reflection mirror 1 and the sub-reflection mirror 2 move, that is, the operation region of the main reflection mirror 1 and the sub-reflection mirror 2 is inside a circle that is drawn by the outermost edge of the main reflection mirror 1 about the elevation shaft 52 as a center.

The operation region represented by that circle is extremely small as compared with that of the conventional antenna as disclosed in, for example, Proceedings of ISAP2000, pp. 497–500, Japan, H. Wakana et al, and the antenna height does not become high even when the reflecting mirror rotates about the elevation shaft.

The main reflection mirror 1 and the sub-reflection mirror 2 are adjusted in their mirror surfaces so as to receive and reflect substantially all of the electromagnetic waves supplied to the main reflection mirror 1 and the sub-reflection mirror 2. Since a specific procedure of this mirror surface adjustment is well known in this technical field, the procedure will not be described in detail. The mirror surface adjustment is a manner for controlling the opening configuration of the antenna and the opening distribution of the antenna, which is described in detail in, for example, IEE Proc. Microw. Antennas Progag. Vol. 146, No. 1, pp. 60–64, 1999. In this example, an adjustment is made on the opening configuration of the antenna to have a substantially rectangular shape, and a mirror surface adjustment is made to make the opening distribution uniform.

The above antenna device is a double-mirror Cassegrain antenna that reflects an electric wave radiated from the primary radiator 3 by the sub-reflection mirror 2, also reflects the reflected electric wave by the main reflection mirror 1 and irradiates the electric wave toward a target although not shown. In the elevation direction, the main reflection mirror 1, the sub-reflection mirror 2, the support mechanism 53 of the sub-reflection mirror 2, the primary radiator 3 and the circular waveguide 4 can rotate about the elevation rotary shaft 52 as center. The circular waveguide 4 is connected to the circular waveguide 7 through the rotary joint 5, and can supply power to the primary radiator 3 even if the antenna rotates about the elevation shaft 52.

Also, in addition to the above-mentioned structural component that rotates about the elevation shaft 52, the rotary joint 5 and the circular waveguide 7 are fixed on the rotary mechanism 9, and because the antenna that can rotate about the azimuth shaft 51 (in azimuth direction) can scan freely by two axes of elevation and azimuth, a beam of the antenna can be directed toward an arbitrary direction. FIG. 2(*b*) is a diagram showing the reflecting mirror antenna device as viewed from the top (from the mirror axis direction).

The reflecting mirror antenna device is characterized by designing the antenna in such a manner that not only the antenna height H but also the size (width) W in a direction perpendicular to the elevation shaft 52 and the azimuth shaft 51 becomes small so that the antenna height does not become high even when the antenna device scans in the elevation direction, and the outline of the design procedure of the reflecting mirror antenna device includes the following two steps.

First, an axial symmetric Cassegrain antenna having the antenna height: H=D/4 is designed o that the height of the antenna in a state where antenna does not scan becomes low. The condition is a condition where the antenna height H including the main reflection mirror 1 and the sub-reflection mirror 2 becomes lowest with the same opening diameter when the sub-reflection mirror 2 is a perfect hyperboloid and the main reflection mirror 1 is a perfect paraboloid.

Subsequently, in order to lower the antenna height H when scanning about the elevation shaft 52 (in elevation direction), the mirror surface is adjusted so that the size (width) W of the main reflection mirror 1 in a direction perpendicular to both of the azimuth shaft 51 and the elevation shaft 52 becomes small.

The mirror surface adjustment is a manner for controlling the opening configuration of the antenna and the opening distribution of the antenna, which is disclosed in, for example, IEE Proc. Microw. Antennas Propag. Vol. 146, No. 1, pp. 60–64, 1999 mentioned above. The mirror surface is adjusted, thereby being capable of realizing various configurations of the antenna opening and the opening distribution. Also, the opening diameter D of the antenna is adjusted, thereby being capable of adjusting the gain of the antenna and the beam width in the azimuth direction. In addition, the opening distribution of the antenna is controlled at the time of adjusting the mirror surface, thereby being capable of adjusting the gain and beam width of the antenna.

As described above, according to the embodiment shown in FIG. 2, because the antenna portion and the rotary joint portion are connected to each other by the circular waveguides 4 and 7 that have a plurality of 90-degree bendings and compensate the circularly polarized wave characteristic, and an adjustment that the opening configuration of the antenna is shaped into a substantial rectangle and a mirror surface adjustment that the opening distribution is made uniform are conducted on the antenna device, it is possible to appropriately reduce the height of a portion of the antenna device upper than the azimuth shaft rotary mechanism 9 without deterioration of the electric characteristic, and there can be obtained a mechanical drive reflecting mirror antenna device that can appropriately reduce the height of a portion of the antenna device upper than the mechanical drive reflecting mirror azimuth shaft rotary mechanism 9 which enables the downsizing, the low attitude and the wide-angle scanning and is high in performance, and enables the downsizing, the low attitude and wide-angle scanning while keeping the low attitude of the entire antenna device and is high in performance.

Second Embodiment

Figure 3:
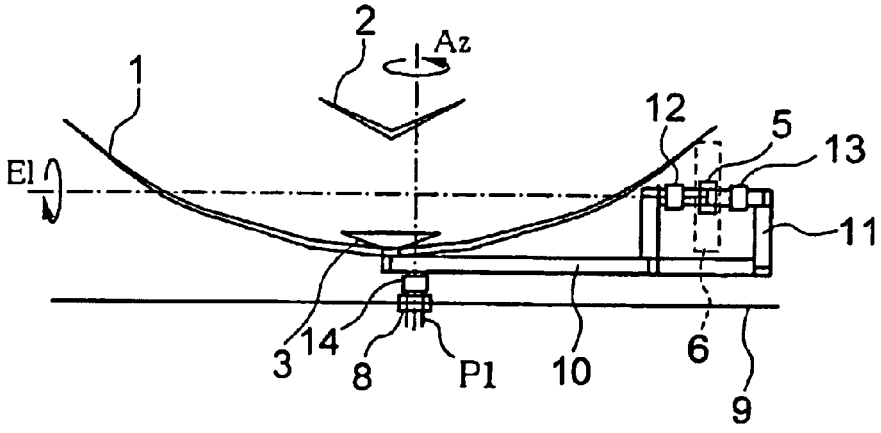
FIG. 3 is a side view showing an antenna device in accordance with a second embodiment of the present invention.
Figure 4:
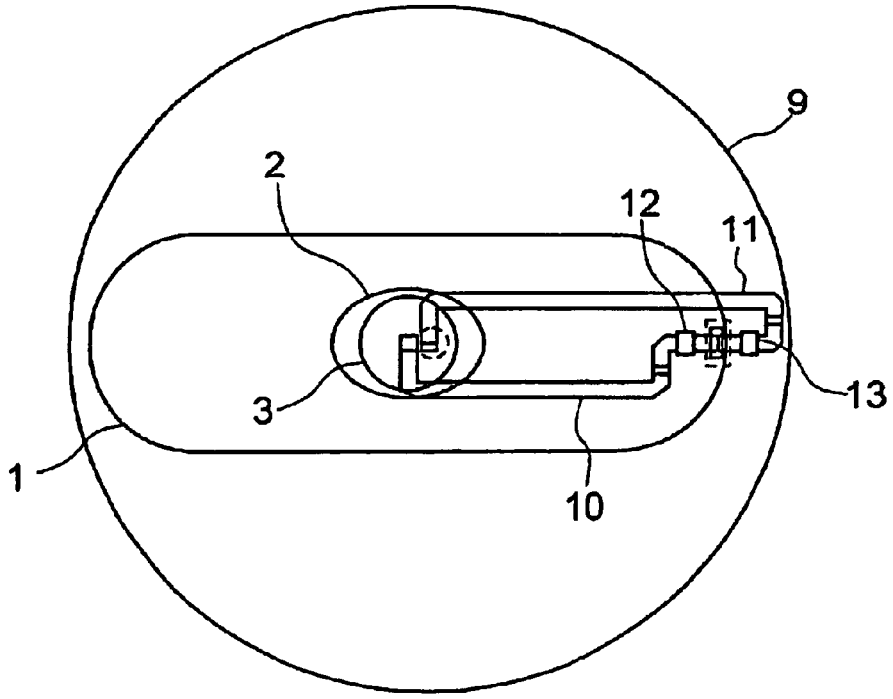
FIG. 4 is a top view showing the antenna device in accordance with the second embodiment of the present invention.

FIG. 3 is a side view showing a mechanical drive reflecting mirror antenna device in accordance with a second embodiment of the present invention, and FIG. 4 is a top view of the mechanical drive reflecting mirror antenna device.

Referring to FIGS. 3 and 4, the same parts as those in the first embodiment shown in FIGS. 1 and 2 are designated by like reference symbols, and their description will be omitted. As new reference numerals, reference numerals 10 and 11 are square waveguides; and 12 to 14 are square-circle waveguide multi-step transformers as square-circle waveguide transforming portions.

In the above-mentioned first embodiment, there are provided the circular waveguides 4 and 7, but in the second embodiment, as shown in FIGS. 3 and 4, there is provided the square waveguide 10 having three bend portions that are bent at 90 degrees on the vertical plane and three bend portions that are bent at 90 degrees on the horizontal plane instead of the circular waveguide 4, there is provided the square waveguide 11 having three bend portions that are bent at 90 degrees on the vertical plane and three bend portions that are bent at 90 degrees on the horizontal plane instead of the circular waveguide 7, and there are provided the square-circle waveguide multi-step transformers 12 to 14.

With the above structure, since the reflection characteristic at the waveguide bend portions can be improved over the wide band, there can be realized the mechanical drive reflecting mirror antenna device low in attitude and high in performance having the more excellent reflection characteristic.

Third Embodiment

Figure 5:
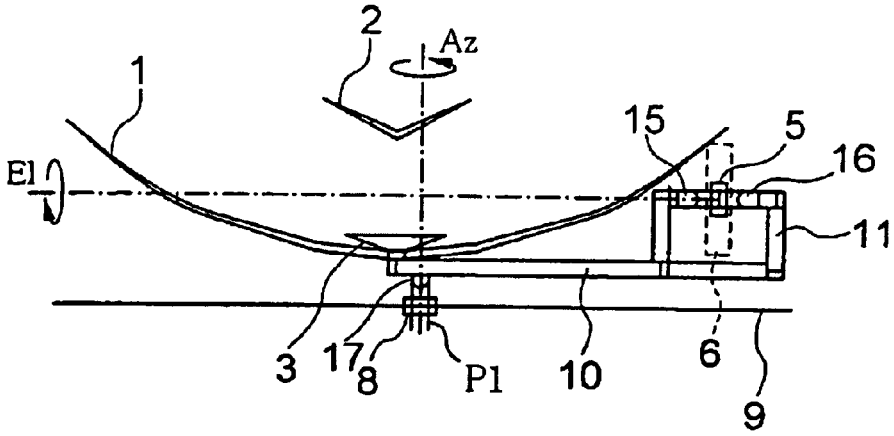
FIG. 5 is a side view showing an antenna device in accordance with a third embodiment of the present invention.
Figure 6:
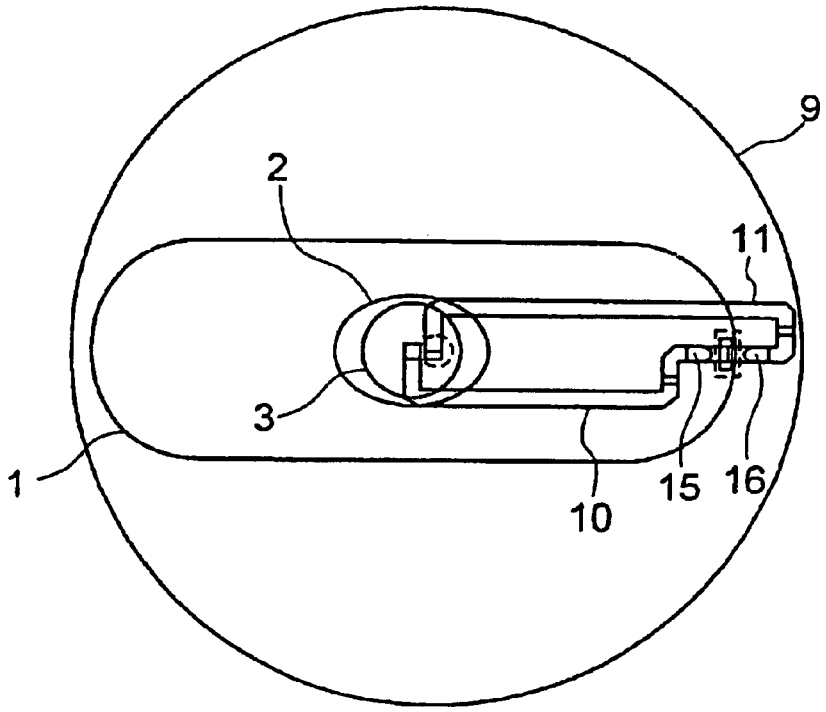
FIG. 6 is a top view showing the antenna device in accordance with the third embodiment of the present invention.

FIG. 5 is a side view showing a mechanical drive reflecting mirror antenna device in accordance with a third embodiment of the present invention, and FIG. 6 is a top view of the mechanical drive reflecting mirror antenna device.

In FIGS. 5 and 6, the same parts as those in the second embodiment shown in FIGS. 3 and 4 are designated by like reference symbols and their description will be omitted. As new reference numerals, reference numerals 15 to 17 are square-circle waveguide tapers as the square-circle waveguide transforming portions.

In the above-mentioned second embodiment, there are provided the square-circle waveguide multi-step transformers 12 to 14, but in the third embodiment, as shown in FIGS. 5 and 6, there are provided the square-circle waveguide tapers 15 to 17.

With the above structure, since the reflection characteristic at the square-circle waveguide transforming portion can be improved over the wide band, there can be realized the mechanical drive reflecting mirror antenna device low in attitude and high in performance having the more excellent reflection characteristic.

Fourth Embodiment

Figure 7:
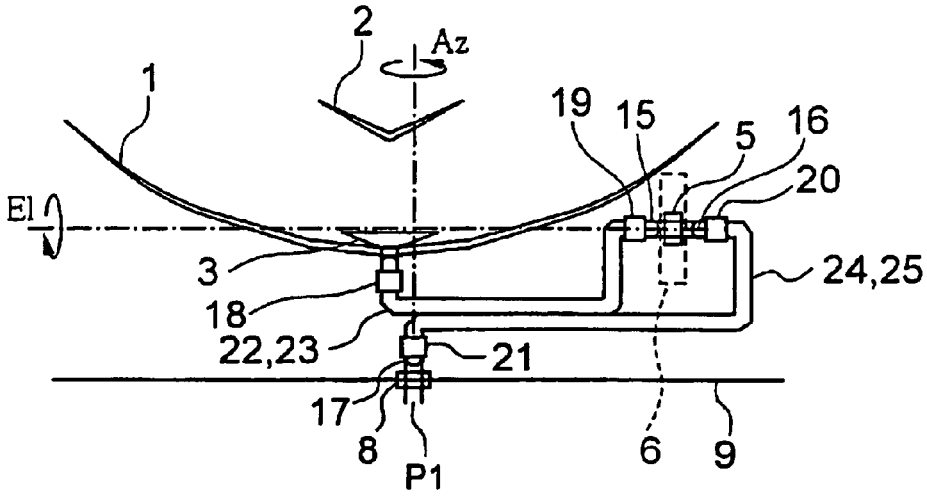
FIG. 7 is a side view showing an antenna device in accordance with a fourth embodiment of the present invention.
Figure 8:
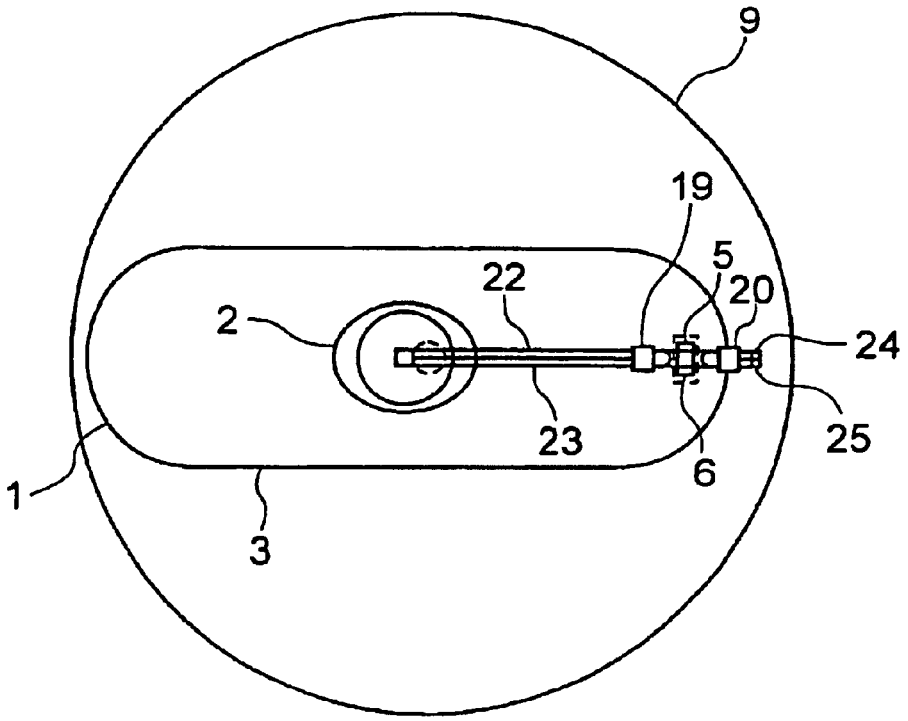
FIG. 8 is a top view showing the antenna device in accordance with the fourth embodiment of the present invention.
Figure 9:
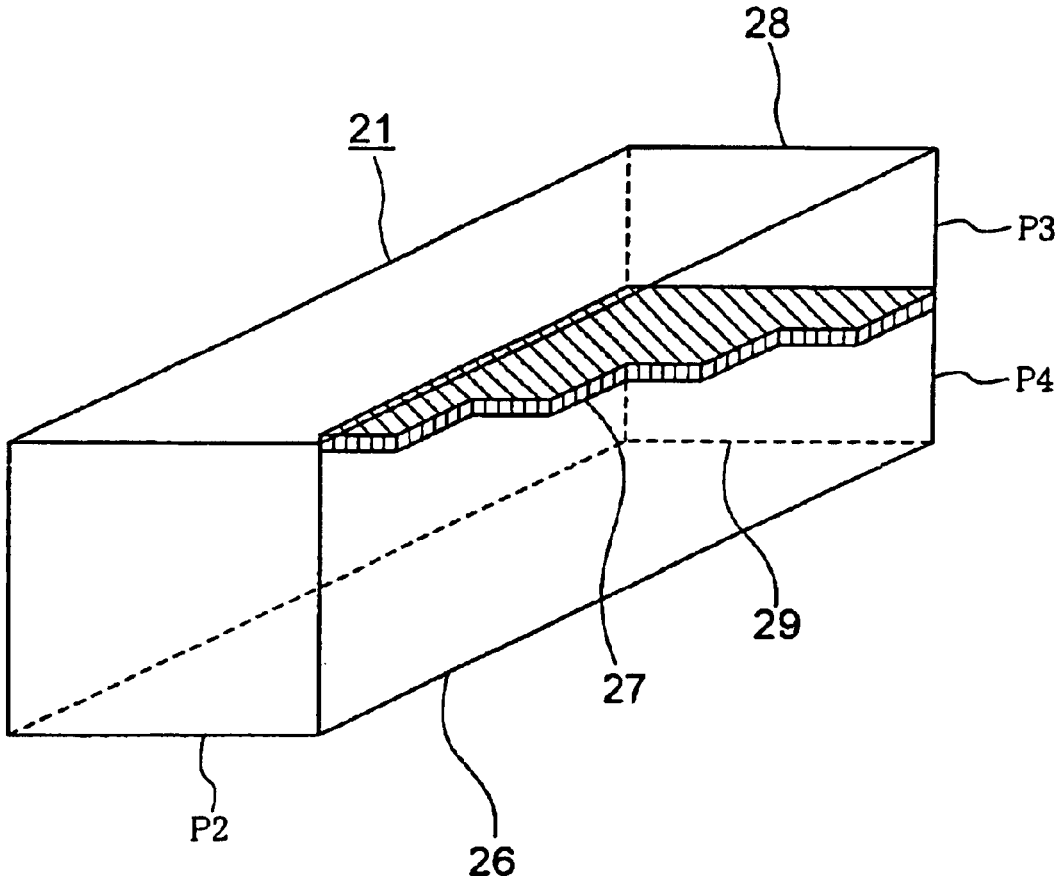
FIG. 9 is a structural view showing a septum-type circularly polarized wave generator in accordance with the fourth embodiment.

FIG. 7 is a side view showing an antenna device in accordance with a fourth embodiment of the present invention, and FIG. 8 is a top view of the antenna device. Also, FIG. 9 is a schematically structural view of a septum-type circularly polarized wave generator disclosed in, for example, J. Uher, J. Bornemann, U. Rosenberg, "Waveguide Components for Antenna Feed Systems: Theory and CAD", ARTECH HOUSE INC., pp. 432–435, 1993.

Referring to FIGS. 7 and 8, the same parts as those in the above-mentioned respective embodiments are designated by like reference symbols and their description will be omitted. As new reference numerals, reference numerals 18 to 21 are septum-type circularly polarized wave generators that serve as orthogonal polarization diplexers that transform a circularly polarized wave or a linearly polarized wave having an arbitrary angle into a rectangular waveguide mode, and 22 to 25 are rectangular waveguides.

In this example, the tubular axis of the circular waveguide rotary joint 5 is on the horizontal plane that divides the height of a portion of the antenna device upper than the azimuth shaft rotary mechanism 9 into substantially two equal parts. Also, the rectangular waveguides 22 and 23 have three H-plane bend portions that are bent at 90 degrees on the vertical plane, and are also wired in parallel with each other with the same configuration. In addition, the rectangular waveguides 24 and 25 have four H-plane bend portions that are bent at 90 degrees on the vertical plane, and are also wired in parallel with each other with the same configuration. In addition, the main reflection mirror 1 and the primary radiator 3 are so disposed as to be directed upward, and the sub-reflection mirror 2 is so disposed as to be directed downward.

Also, referring to FIG. 9, reference numeral 26 denotes a square waveguide; 27 is a stepped metal thin plate; 28 and 29 are rectangular waveguides structured by partitioning the square waveguide 26 by a metal thin plate 27; P2 is a right-handed and left-handed circularly polarized wave input/output terminal; P3 is a linearly polarized wave input/output terminal, the linearly polarized wave being transformed from a right-handed circularly polarized wave or transformed to the right-handed circularly polarized wave; and P4 is a linearly polarized wave input/output terminal, the linearly polarized wave being transformed from a left-handed circularly polarized wave or transformed to the left-handed circularly polarized wave.

Subsequently, the operation will be described. Assuming that the electric wave R1 of the right-handed circularly polarized wave of the circular waveguide TE11 mode is inputted from the terminal P1, the electric wave R1 passes through the rotary joint 8 and the square-circle waveguide taper 17 and is then inputted to the terminal P2 of the septum-type circularly polarized wave generator 21. In this situation, the electric wave R1 is transformed into the linearly polarized wave inputted only from the terminal P3 of the septum-type circularly polarized wave generator 21.

The electric wave R1 that has been transformed into the linearly polarized wave is propagated in the rectangular waveguide 24 and then inputted to the terminal P3 of the septum-type circularly polarized wave generator 20. In this situation, after being again transformed to the right-handed circularly polarized wave, the electric wave R1 passes through the square-circle waveguide taper 16, the rotary joint 5 and the square-circle waveguide taper 15 and is then inputted to the terminal P2 of the septum-type circularly polarized wave generator 19. In this example, the electric wave R1 is transformed to the linearly polarized wave inputted only from the terminal P3 of the septum-type circularly polarized wave generator 19.

The electric wave R1 transformed to the linearly polarized wave is propagated in the rectangular waveguide 22 and then inputted to the terminal P3 of the septum-type circularly polarized wave generator 18. In this example, after being again transformed to the right-handed circularly polarized wave, the electric wave R1 is radiated toward the air from the main reflection mirror 1 through the primary radiator 3 and the sub-reflection mirror 2 as the right-handed circularly polarized wave.

In this example, there is advantageous in that a design can be readily made that the reflection at the bend portions having the respective H planes bent at 90 degrees when the electric wave R1 of the circularly polarized wave is propagated through the rectangular waveguide 24 is made very small over the wide band. The same is applied to the propagation of the electric wave R1 through the rectangular waveguide 22.

Also, since the rotary joints 8 and 5 are structured with the circular waveguide TE11 mode used as the propagation mode, the rotary joints 8 and 5 can be driven over the wide angular range without deteriorating the electric characteristic, thereby being capable of transmitting the antenna beam while scanning over the wide angle. Also, the excellent transmission and reflection characteristics over the wide band can be expected.

The above-mentioned operational principle is applied to a time of transmitting the right-handed circularly polarized wave, and the same is applied to a receiving time. Also, the same is applied to a time of transmitting and receiving the left-handed circularly polarized wave.

As described above, according to the fourth embodiment, because the antenna portion and the rotary joint portion are connected to each other by the rectangular waveguide, the degree of freedom of the wiring design is made high, and the height of a portion of the antenna device upper than the azimuth shaft rotary mechanism can be designed so as to be appropriately small without deteriorating the electric characteristic.

Fifth Embodiment

Figure 10:
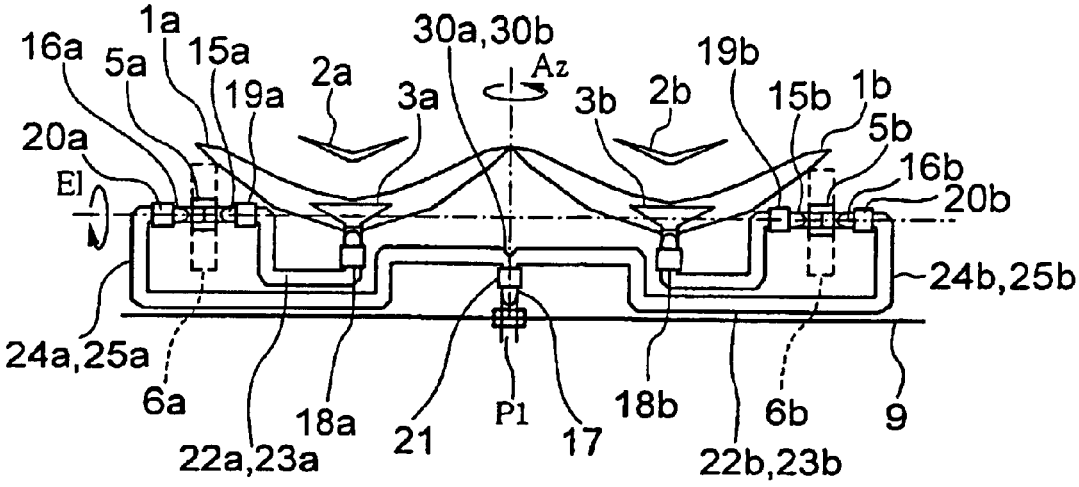
FIG. 10 is a side view showing an antenna device in accordance with a fifth embodiment of the present invention.
Figure 11:
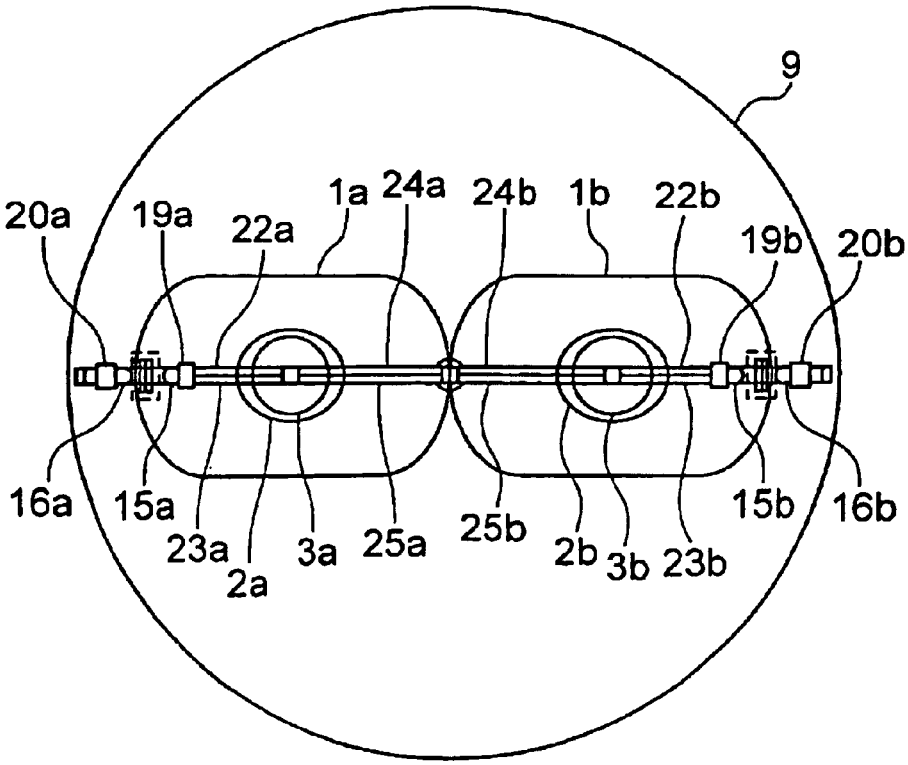
FIG. 11 is a top view showing the antenna device in accordance with the fifth embodiment of the present invention.

FIG. 10 is a side view showing a mechanical drive reflecting mirror antenna device in accordance with a fifth embodiment of the present invention, and FIG. 11 is a top view of the mechanical drive reflecting mirror antenna device.

In FIGS. 10 and 11, reference symbols 1*a* and 1*b* denote main reflection mirrors; 2*a* and 2*b* are sub-reflection mirrors; 3*a* and 3*b* are primary radiators; 5*a* and 5*b* are circular waveguide rotary joints; 6*a* and 6*b* are elevation shaft rotary mechanisms; 15*a*, 15*b*, 16*a* and 16*b* are square-circle waveguide tapers; 18*a*, 18*b*, 19*a*, 19*b*, 20*a* and 20*b* are septum-type circularly polarized wave generators that serve as the orthogonal polarization diplexers; 22*a*, 22*b*, 23*a*, 23*b*, 24*a*, 24*b*, 25*a* and 25*b* are rectangular waveguides; 30*a* and 30*b* are rectangular waveguide H-plane T-branching circuits.

In this example, the rotary axes of the circular waveguide rotary joints 5*a* and 5*b* are coaxial and are arranged on the horizontal plane that divides the height of a portion of the antenna device upper than the azimuth shaft rotary mechanism 9 into substantially two equal parts. Also, the rectangular waveguides 22*a*, 22*b*, 23*a* and 23*b* have three H-plane bend portions that are bent at 90 degrees on the vertical plane, and are also wired in parallel with each other with the same configuration. In addition, the rectangular waveguides 24*a*, 24*b*, 25*a* and 25*b* have four H-plane bend portions that are bent at 90 degrees on the vertical plane, and are also wired in parallel with each other with the same configuration. Also, the rectangular waveguide H-plane T-branching circuits 30*a* and 30*b* are arranged in parallel with each other on the same configuration. In addition, the main reflection mirrors 1*a*, 1*b* and the primary radiators 3*a*, 3*b* are so disposed as to be directed upward, and the sub-reflection mirrors 2*a* and 2*b* are so disposed as to be directed downward.

Then, the operation will be described. Assuming that the electric wave R1 of the right-handed circularly polarized wave of the circular waveguide TE11 mode is inputted from the terminal P1, the electric wave R1 passes through the rotary joint 8 and the square-circle waveguide taper 17 and is then inputted to the terminal P2 of the septum-type circularly polarized wave generator 21. In this situation, the electric wave R1 is transformed into a linearly polarized wave that is inputted only from the terminal P3 of the septum-type circularly polarized wave generator 21.

The electric wave R1 transformed into the linearly polarized wave is distributed into an electric wave R1*a* and an electric wave R1*b* in two equal powers by the rectangular waveguide H-plane T-branching circuit 30*a*.

The distributed electric wave R1*a* is propagated in the rectangular waveguide 24*a* and is then inputted to the terminal P3 of the septum-type circularly polarized wave generator 20*a*. In this situation, after the electric wave R1*a* has been again transformed into the right-handed circularly polarized wave, the electric wave R1*a* passes through the square-circle waveguide taper 16*a*, the rotary joint 5*a* and the square-circle waveguide taper 15*a* and is then inputted to the terminal P2 of the septum-type circularly polarized wave generator 19*a*. Then, the electric wave R1*a* is transformed into a linearly polarized wave that is inputted only from the terminal P3 of the septum-type circularly polarized wave generator 19*a*.

Further, the electric wave R1*a* transformed to the linearly polarized wave is propagated in the rectangular waveguide 22*a* and then inputted to the terminal P3 of the septum-type circularly polarized wave generator 18*a*. In this example, after being again transformed to the right-handed circularly polarized wave, the electric wave R1*a* is radiated toward the air from the main reflection mirror 1*a* through the primary radiator 3*a* and the sub-reflection mirror 2*a* as the right-handed circularly polarized wave.

Likewise, the distributed electric wave R1*b* is propagated in the rectangular waveguide 24*b* and is then inputted to the terminal P3 of the septum-type circularly polarized wave generator 20*b*. In this situation, after the electric wave R1*b* has been again transformed into the right-handed circularly polarized wave, the electric wave R1*b* passes through the square-circle waveguide taper 16*b*, the rotary joint 5*b* and the square-circle waveguide taper 15*b* and is then inputted to the terminal P2 of the septum-type circularly polarized wave generator 19*b*. Then, the electric wave R1*b* is transformed into a linearly polarized wave that is inputted only from the terminal P3 of the septum-type circularly polarized wave generator 19*b*.

Further, the electric wave R1*b* transformed to the linearly polarized wave is propagated in the rectangular waveguide 22*b* and then inputted to the terminal P3 of the septum-type circularly polarized wave generator 18*b*. In this example, after being again transformed to the right-handed circularly polarized wave, the electric wave R1*b* is radiated toward the air from the main reflection mirror 1*b* through the primary radiator 3*b* and the sub-reflection mirror 2*b* as the right-handed circularly polarized wave.

In this example, there is advantageous in that a design can be readily made that the reflection at the bend portions having the respective H planes bent at 90 degrees when the electric wave R1 of the circularly polarized wave is propagated through the rectangular waveguides 22*a* to 25*b* is made very small over the wide band. The same is applied to the propagation of the electric wave R1 through the rectangular waveguide 22.

Also, since the rotary joints 8, 5*a* and 5*b* are structured with the circular waveguide TE11 mode used as the propagation mode, the rotary joints 8, 5*a* and 5*b* can be driven over the wide angular range without deteriorating the electric characteristic, thereby being capable of transmitting the antenna beam while scanning over the wide angle. Also, the excellent transmission and reflection characteristics over the wide band can be expected In addition, since two main reflection mirrors are employed, the height of from the main reflection mirror 1 to the sub-reflection mirror 2 can be so designed as to be small as compared with an antenna device having one main reflection mirror which obtains the same radiation characteristic, thereby being capable of more downsizing the antenna device without deteriorating the radiation characteristic.

The above-mentioned operational principle is applied to a time of transmitting the right-handed circularly polarized wave, but the same is applied to a receiving time. Also, the same is applied to a time of transmitting and receiving the left-handed circularly polarized wave.

As described above, according to the fifth embodiment, since there are two systems of the main reflection mirrors and the sub-reflection mirrors, and the antenna portion and the rotary joint portions are connected to each other by the rectangular waveguide with the effects that the degree of freedom of the wiring design is made high, and the height of a portion of the antenna device upper than the azimuth shaft rotary mechanism can be so designed as to be smaller without deteriorating the electric characteristic.

Sixth Embodiment

Figure 12:
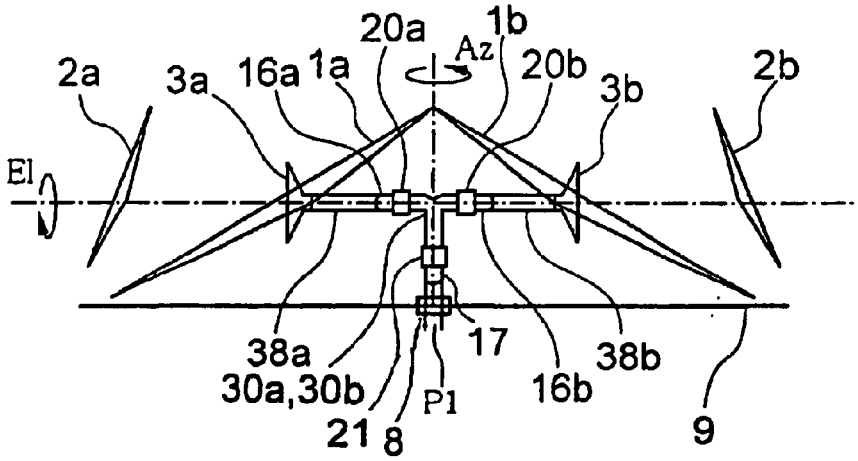
FIG. 12 is a side view showing an antenna device in accordance with a sixth embodiment of the present invention.
Figure 13:
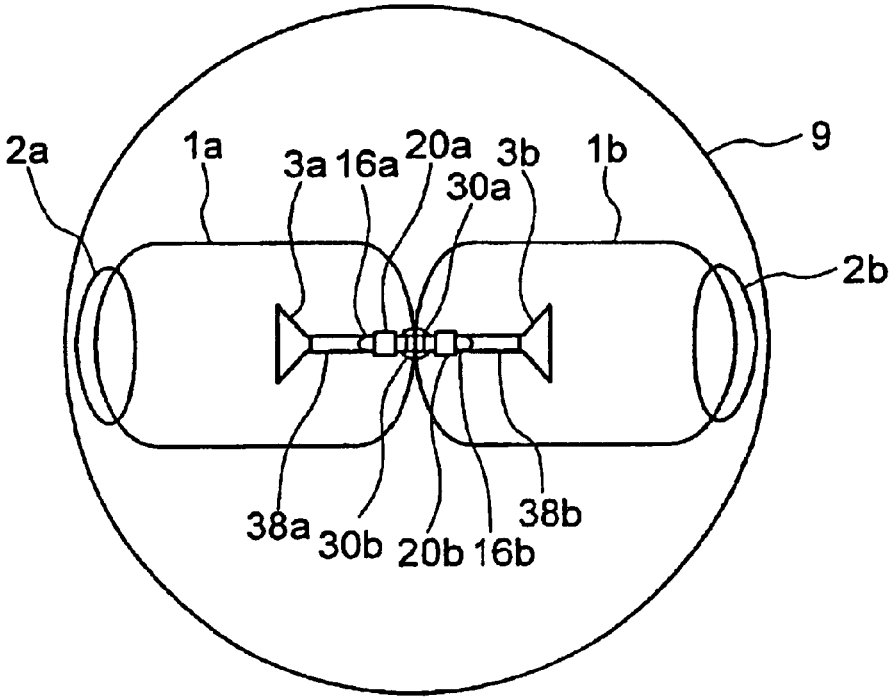
FIG. 13 is a top view showing the antenna device in accordance with the sixth embodiment of the present invention.

FIG. 12 is a side view showing a mechanical drive reflecting mirror antenna device in accordance with a sixth embodiment of the present invention, and FIG. 13 is a top view of the mechanical drive reflecting mirror antenna device.

Referring to FIGS. 12 and 13, the same parts as those in the fifth embodiment shown in FIGS. 10 and 11 are designated by like reference symbols, and their description will be omitted. As new reference symbols, reference symbols 38*a* and 38*b* are circular waveguides.

In this example, the main reflection mirrors 1*a* and l*b* are located obliquely upwardly, the sub-reflection mirrors 2*a* and 2*b* are disposed obliquely downward, and the primary radiators 3*a* and 3*b* are located to be directed horizontally. Only the main reflection mirrors 1*a*, 1*b* and the sub-reflection mirrors 2*a*, 2*b* are so designed as to rotate in an elevation rotary direction E1.

Then, the operation will be described. Assuming that the electric wave R1 of the right-handed circularly polarized wave of the circular waveguide TE11 mode is inputted from the terminal P1, the electric wave R1 passes through the rotary joint 8 and the square-circle waveguide taper 17 and is then inputted to the terminal P2 of the septum-type circularly polarized wave generator 21 that serves as a orthogonal polarization diplexer. In this situation, the electric wave R1 is transformed into a linearly polarized wave that is inputted only from the terminal P3 of the septum-type circularly polarized wave generator 21.

The electric wave R1 transformed into the linearly polarized wave is distributed into an electric wave R1*a* and an electric wave R1*b* in two equal powers by the rectangular waveguide H-plane T-branching circuit 30*a*.

The distributed electric wave R1*a* is inputted to the terminal P3 of the septum-type circularly polarized wave generator 20*a* that serves as the orthogonal polarization diplexer. In this situation, after the electric wave R1*a* has been again transformed into the right-handed circularly polarized wave, the electric wave R1*a* passes through the square-circle waveguide taper 16*a* and the circular waveguide 38*a*, and is then radiated toward the air from the main reflection mirror 1*a* through the primary radiator 3*a* and the sub-reflection mirror 2*a* as the right-handed circularly polarized wave.

Likewise, the distributed electric wave R1*b* is inputted to the terminal P3 of the septum-type circularly polarized wave generator 20*b* that serves as the orthogonal polarization diplexer. In this situation, after the electric wave R1*b* has been again transformed into the right-handed circularly polarized wave, the electric wave R1*b* passes through the square-circle waveguide taper 16*b* and the circular waveguide bend 31*b*, and is then radiated toward the air from the main reflection mirror 1*b* through the primary radiator 3*b* and the sub-reflection mirror 2*b* as the right-handed circularly polarized wave.

In this way, there is advantageous in that the size of a power feeding circuit of from the rotary joint 8 to the primary radiators 3*a*, 3*b* can be very reduced. Also, there is advantageous in that a design can be made to reduce a loss when the electric wave R1 of the circularly polarized wave is propagated from the rotary joint 8 to the primary radiators 3*a*, 3*b*.

Also, since the rotary joint 8 is structured with the circular waveguide TE11 mode used as the propagation mode, the rotary joint 8 can be driven over the wide angular range without deteriorating the electric characteristic, thereby being capable of transmitting the antenna beam while scanning over the wide angle. Also, the excellent transmission and reflection characteristics can be expected over the wide band.

In addition, since two main reflection mirrors are employed, the height of from the main reflection mirror 1 to the sub-reflection mirror 2 can be so designed as to be small as compared with an antenna device having one main reflection mirror which obtains the same radiation characteristic, thereby being capable of more downsizing the antenna device without deteriorating the radiation characteristic.

The above-mentioned operational principle is applied to a time of transmitting the right-handed circularly polarized wave, but the same is applied to a receiving time. Also, the same is applied to a time of transmitting and receiving the left-handed circularly polarized wave.

As described above, according to the sixth embodiment, since there are two systems of the main reflection mirrors and the sub-reflection mirrors that are located obliquely downward or upward, and the antenna portion and the rotary joint portions are connected to each other by the rectangular waveguide with the effects that the size of the power feeding circuit can be reduced, the degree of freedom of the wiring design is made high, and the height of a portion of the antenna device upper than the azimuth shaft rotary mechanism can be so designed as to be smaller without deteriorating the electric characteristic.

Seventh Embodiment

Figure 14:
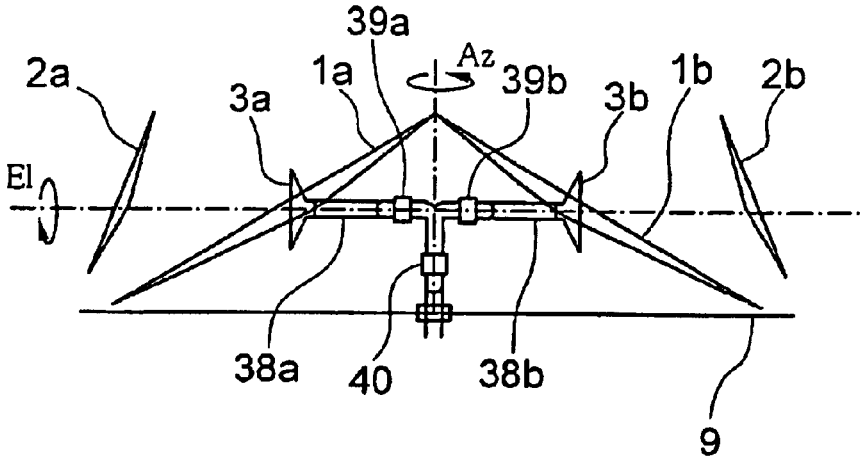
FIG. 14 is a side view showing an antenna device in accordance with a seventh embodiment of the present invention.
Figure 15:
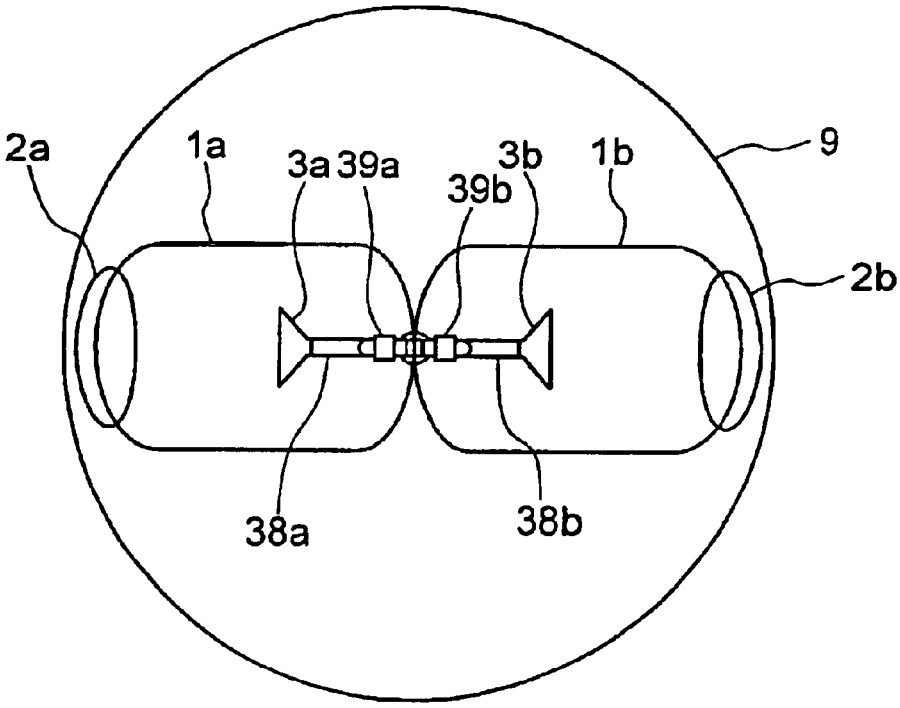
FIG. 15 is a top view showing the antenna device in accordance with the seventh embodiment of the present invention.

FIG. 14 is a side view showing a mechanical drive reflecting mirror antenna device in accordance with a seventh embodiment of the present invention, and FIG. 15 is a top view of the mechanical drive reflecting mirror antenna device.

Referring to FIGS. 14 and 15, the same parts as those in the sixth embodiment shown in FIGS. 12 and 13 are designated by like reference symbols, and their description will be omitted. As new reference symbols, reference symbols 39*a*, 39*b*, and 40 are polarization dividers as orthogonal polarization diplexers.

In the above-mentioned sixth embodiment, the septum circularly polarized wave generators 20 and 21 are employed as the orthogonal polarization diplexer, but if polarization dividers 39 and 40 are employed instead of the septum circularly polarized wave generator as shown in FIGS. 14 and 15, it can be expected to realize the low-attitude mechanical drive reflecting mirror antenna device excellent in the reflection characteristic over the wide band.

Eighth Embodiment

Figure 16:
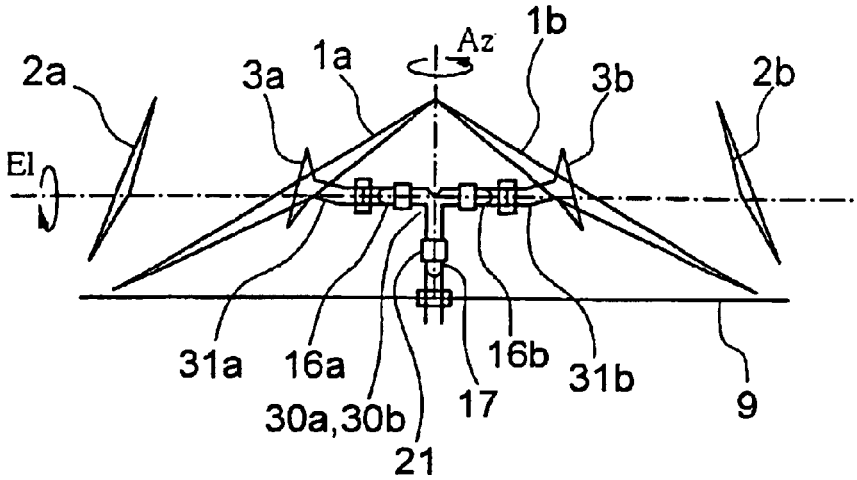
FIG. 16 is a side view showing an antenna device in accordance with an eighth embodiment of the present invention.
Figure 17:
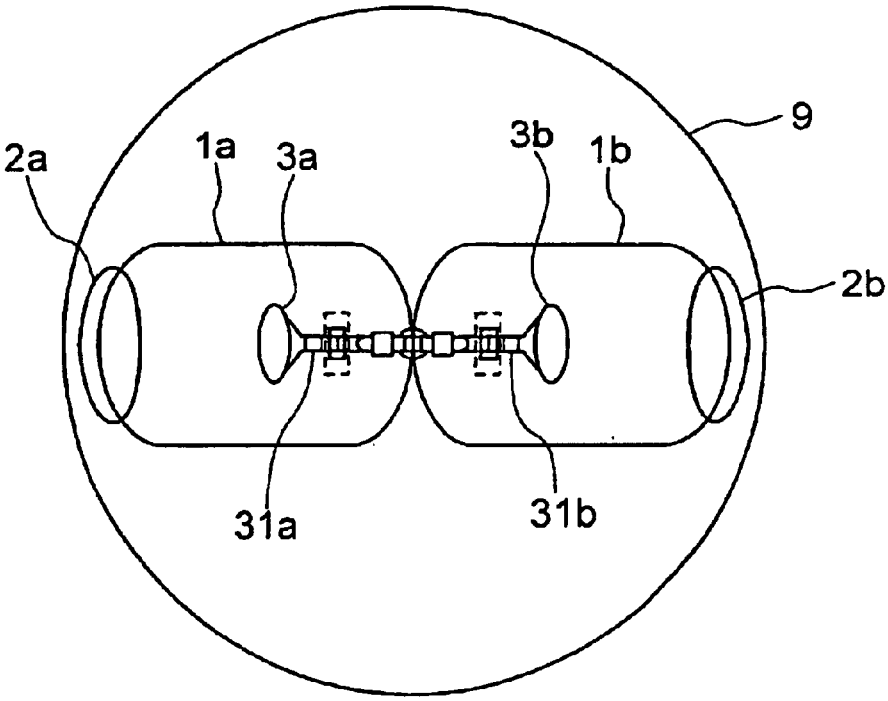
FIG. 17 is a top view showing the antenna device in accordance with the eighth embodiment of the present invention.

FIG. 16 is a side view showing a mechanical drive reflecting mirror antenna device in accordance with an eighth embodiment of the present invention, and FIG. 17 is a top view of the mechanical drive reflecting mirror antenna device.

Referring to FIGS. 16 and 17, the same parts as those in the seventh embodiment shown in FIGS. 14 and 15 are designated by like reference symbols, and their description will be omitted. As new reference symbols, reference symbols 31*a* and 31*b* are circular waveguide bends.

In the above-mentioned sixth and seventh embodiments, the primary radiators 3*a* and 3*b* are located horizontally, but if the primary radiators 3*a* and 3*b* are so located as to be directed obliquely upward, and the circular waveguide bends 31*a* and 31*b* are employed instead of the circular waveguide 38 as shown in FIGS. 16 and 17, the height of from the main reflection mirror 1 to the sub-reflection mirror 2 can be so designed as to be made further smaller, and the antenna device can be expected to be further downsized without increasing the power feeding circuit and without deteriorating the radiation characteristic.

Ninth Embodiment

Figure 18:
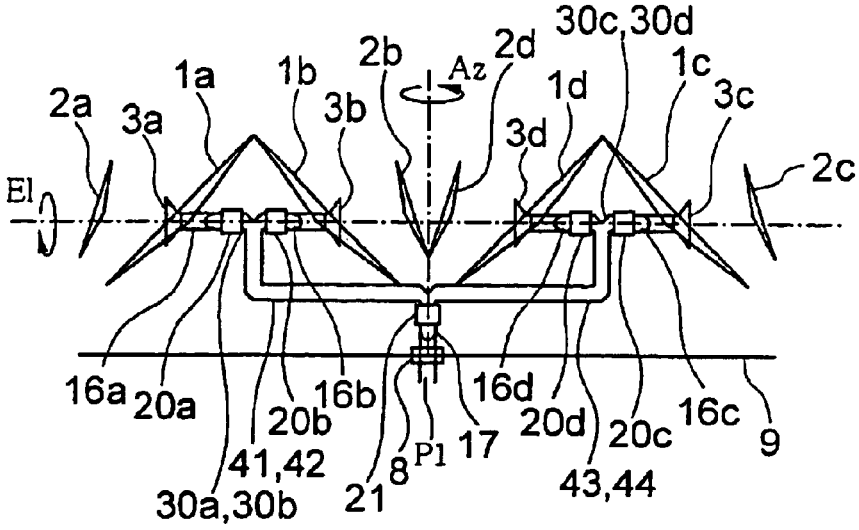
FIG. 18 is a side view showing an antenna device in accordance with a ninth embodiment of the present invention.
Figure 19:
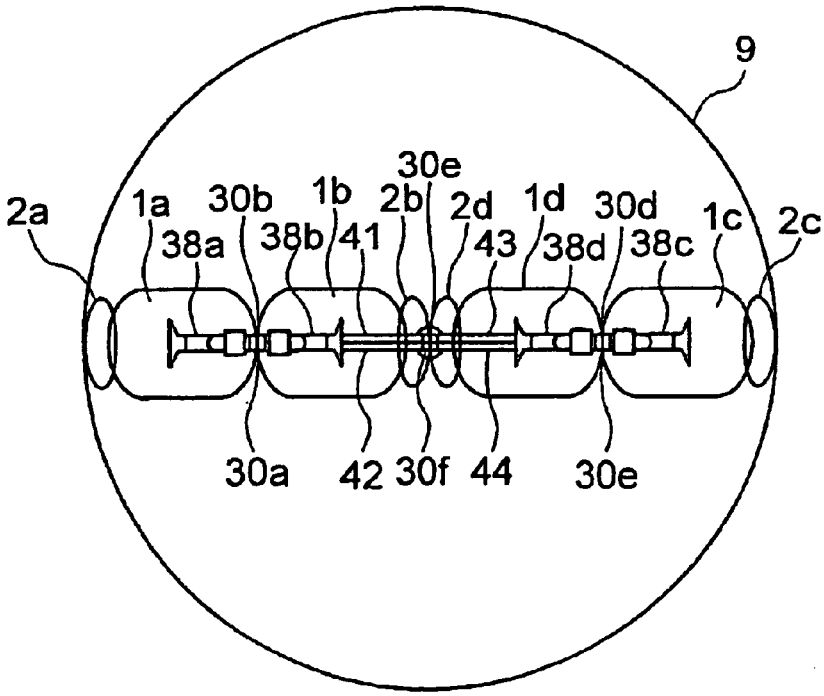
FIG. 19 is a top view showing the antenna device in accordance with the ninth embodiment of the present invention.

FIG. 18 is a side view showing a mechanical drive reflecting mirror antenna device in accordance with a ninth embodiment of the present invention, and FIG. 19 is a top view of the mechanical drive reflecting mirror antenna device.

In FIGS. 18 and 19, reference symbols 1*a* to 1*d* denote main reflection mirrors; 2*a* to 2*d* are sub-reflection mirrors; 3*a* to 3*d* are primary radiators; 38*a* to 38*d* are circular waveguides; 16*a* to 16*d* and 17 are square-circle waveguide tapers; 20*a* to 20*d* and 21 are septum-type circularly polarized wave generators; 30*a* to 30*f* are rectangular waveguide H-plane T-branching circuits; 41 to 44 are rectangular waveguides; 8 is a circular waveguide rotary joint; and 9 is an azimuth shaft rotary mechanism.

In this example, the main reflection mirrors 1*a* to 1*d* are so located as to be directed obliquely upward, the sub-reflection mirrors 2*a* to 2*d* are so located as to be directed obliquely downward, and the primary radiators 3*a* to 3*d* are so located as to be directed horizontally. Also, only the main reflection mirrors 1*a* to 1*d* and the sub-reflection mirrors 2*a* to 2*d* are so structured as to rotate about the elevation shaft on the same axis.

Then, the operation will be described. Assuming that the electric wave R1 of the right-handed circularly polarized wave of the circular waveguide TE11 mode is inputted from the terminal P1, the electric wave R1 passes through the rotary joint 8 and the square-circle waveguide taper 17 and is then inputted to the terminal P2 of the septum-type circularly polarized wave generator 21. In this situation, the electric wave R1 is transformed into a linearly polarized wave that is inputted only from the terminal P3 of the septum-type circularly polarized wave generator 21.

The electric wave R1 transformed into the linearly polarized wave is distributed into an electric wave R1*e* and an electric wave R1*f* in two equal powers by the rectangular waveguide H-plane T-branching circuit 30*e*. The distributed electric wave R1*e* is inputted to the rectangular waveguide H-plane T-branching circuit 30*a* through the rectangular waveguide 41. In this situation, the electric wave R1*e* is distributed into the electric waves R1*a* and R1*b* in two equal powers by the T-branching circuit 30*a*.

The distributed electric wave R1*a* is inputted to the terminal P3 of the septum-type circularly polarized wave generator 20*a*. In this situation, after the electric wave R1*a* has been again transformed into the right-handed circularly polarized wave, the electric wave R1*a* passes through the square-circle waveguide taper 16*a*, the rotary joint 5*a* and the circular waveguide 38*a*, and is then radiated toward the air from the main reflection mirror 1*a* through the primary radiator 3*a* and the sub-reflection mirror 2*a* as the right-handed circularly polarized wave.

Likewise, the distributed electric wave R1*b* is inputted to the terminal P3 of the septum-type circularly polarized wave generator 20*b*. In this situation, after the electric wave R1*b* has been again transformed into the right-handed circularly polarized wave, the electric wave R1*b* passes through the square-circle waveguide taper 16*b*, the rotary joint 5*b* and the circular waveguide bend 31*b*, and is then radiated toward the air from the main reflection mirror 1*b* through the primary radiator 3*b* and the sub-reflection mirror 2*b* as the right-handed circularly polarized wave.

Likewise, the distributed electric wave R1*f* is inputted to the rectangular waveguide H-plane T-branching circuit 30*a* through the rectangular waveguide 43. In this situation, the electric wave R1*f* is distributed into the electric wave R1*c* and R1*d* in two equal powers by the T-branching circuit 30*c*.

The distributed electric wave R1*c* is inputted to the terminal P3 of the septum-type circularly polarized wave generator 20*c*. In this situation, after the electric wave R1*c* has been again transformed into the right-handed circularly polarized wave, the electric wave R1*c* passes through the square-circle waveguide taper 16*c*, the rotary joint 5*c* and the circular waveguide 38*c*, and is then radiated toward the air from the main reflection mirror 1*c* through the primary radiator 3*c* and the sub-reflection mirror 2*c* as the right-handed circularly polarized wave.

Likewise, the distributed electric wave R1*d* is inputted to the terminal P3 of the septum-type circularly polarized wave generator 20*d*. In this situation, after the electric wave R1*d* has been again transformed into the right-handed circularly polarized wave, the electric wave R1*d* passes through the square-circle waveguide taper 16*d*, the rotary joint 5*d* and the circular waveguide bend 31*d*, and is then radiated toward the air from the main reflection mirror 1*d* through the primary radiator 3*d* and the sub-reflection mirror 2*d* as the right-handed circularly polarized wave.

As described above, since four main reflection mirrors are employed, the height of from the main reflection mirror 1 to the sub-reflection mirror 2 can be so designed as to be small as compared with an antenna device having one main reflection mirror or two main reflection mirrors which obtains the same radiation characteristic, thereby being capable of more downsizing the antenna device without deteriorating the radiation characteristic.

Also, there is advantageous in that the size of a power feeding circuit of from the rotary joint 8 to the primary radiators 3*a* to 3*d* can be relatively reduced. Also, there is advantageous in that a design can be made to reduce a loss when the electric wave R1 of the circularly polarized wave is propagated from the rotary joint 8 to the primary radiators 3*a* to 3*d*.

Also, since the rotary joint 8 is structured with the circular waveguide TE11 mode used as the propagation mode, the rotary joint 8 can be driven over the wide angular range without deteriorating the electric characteristic, thereby being capable of transmitting the antenna beam while scanning over the wide angle. Also, the excellent transmission and reflection characteristics can be expected over the wide band.

The above-mentioned operational principle is applied to a time of transmitting the right-handed circularly polarized wave, but the same is applied to a receiving time. Also, the same is applied to a time of transmitting and receiving the left-handed circularly polarized wave.

As described above, according to the ninth embodiment, since there are four systems of the main reflection mirrors and the sub-reflection mirrors located obliquely downward or upward, and the antenna portion and the rotary joint portions are connected to each other by the rectangular waveguide with the effects that the height of from the main reflection mirror 1 to the sub-reflection mirror 2 can be so designed as to be further reduced, and the antenna device can be expected to be further downsized without deteriorating the radiation characteristic.

Tenth Embodiment

Figure 20:
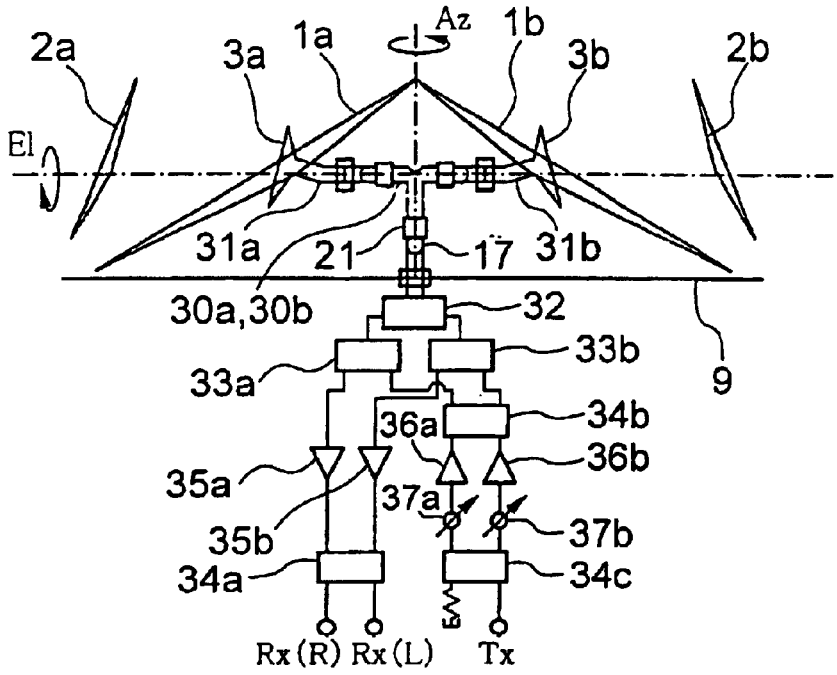
FIG. 20 is a side view showing an antenna device in accordance with a tenth embodiment of the present invention.
Figure 21:
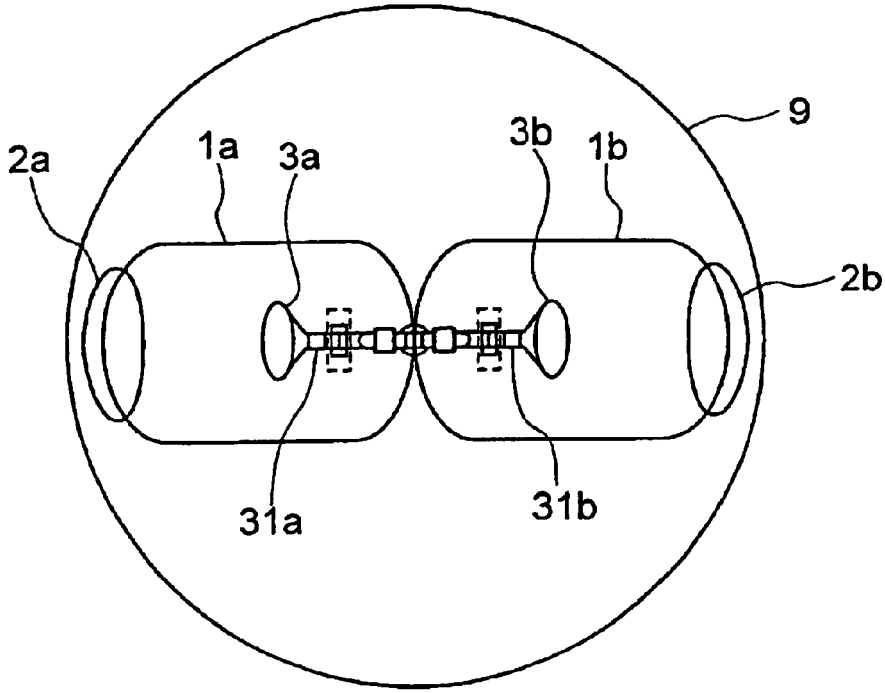
FIG. 21 is a top view showing the antenna device in accordance with the tenth embodiment of the present invention.

FIG. 20 is a side view showing a mechanical drive reflecting mirror antenna device in accordance with a tenth embodiment of the present invention, and FIG. 21 is a top view of the mechanical drive reflecting mirror antenna device.

Referring to FIGS. 20 and 21, the same parts as those in the eighth embodiment shown in FIGS. 16 and 17 are designated by like reference symbols, and their description will be omitted. As new reference numerals, reference numeral 32 is a polarization divider as a orthogonal polarization diplexer; 33*a* and 33*b* are branching filters; 34*a* to 34*c* are 90-degree hybrid circuits; 35*a* and 35*b* are low-noise amplifiers; 36*a* and 36*b* are high-power amplifiers; and 37*a* and 37*b* are variable phase shifters.

In the above-mentioned eighth embodiment, there is shown the antenna device that transmits and receives the circularly polarized wave, but if there are provided as shown in FIGS. 20 and 21, a polarization divider 32, branching filters 33*a* to 33*b*, 90-degree hybrid circuits 34*a* to 34*c*, low-noise amplifiers 35*a* and 35*b*, high-power amplifiers 36*a* and 36*b* and variable phase shifters 37*a* and 37*b*, there can be realized the low-attitude mechanical drive reflecting mirror antenna device that can receive a signal of the right-handed and left-handed circularly polarized waves and transmit the linearly polarized wave of an arbitrary angle.

Eleventh Embodiment

Figure 22:
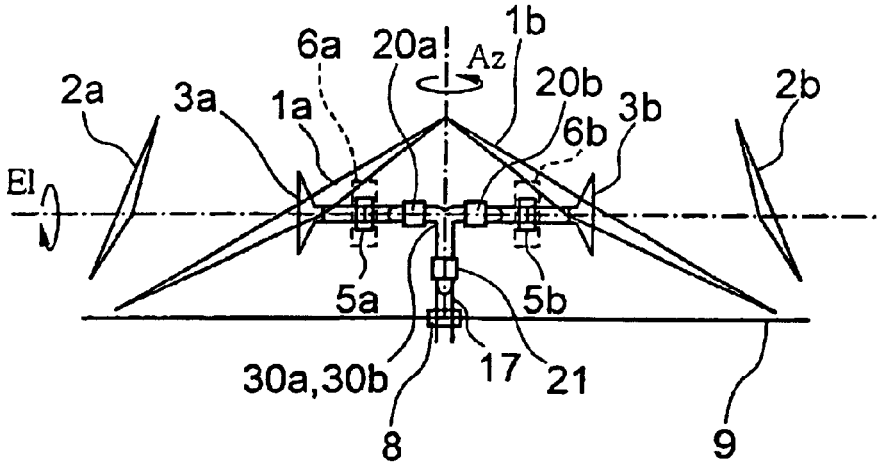
FIG. 22 is a side view showing an antenna device in accordance with an eleventh embodiment of the present invention.
Figure 23:
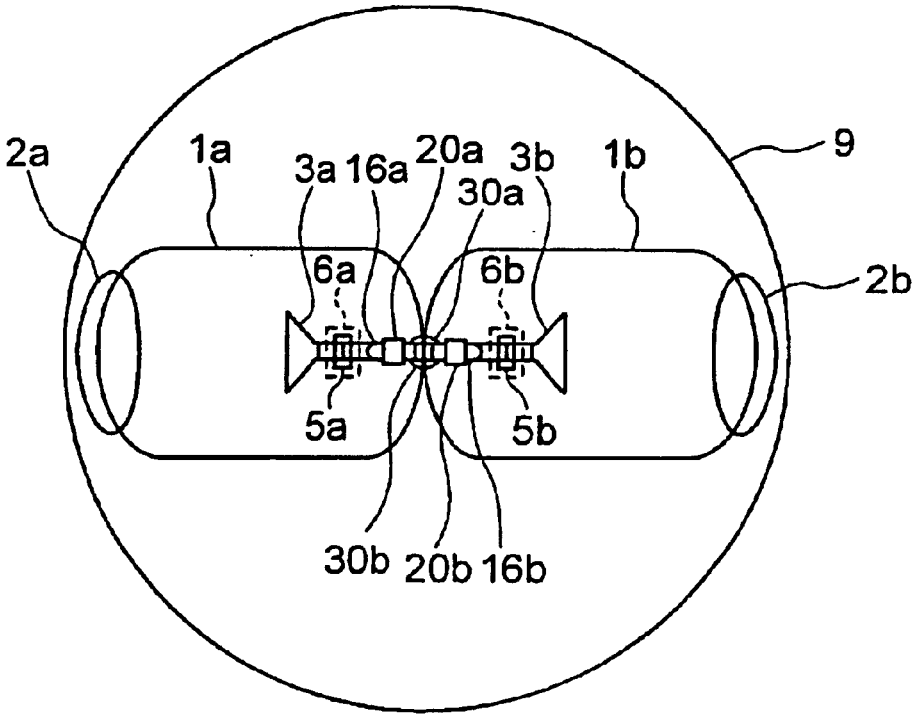
FIG. 23 is a top view showing the antenna device in accordance with the eleventh embodiment of the present invention.

FIG. 22 is a side view showing a mechanical drive reflecting mirror antenna device in accordance with an eleventh embodiment of the present invention, and FIG. 23 is a top view of the mechanical drive reflecting mirror antenna device.

In FIGS. 22 and 23, the same parts as those in the sixth embodiment shown in FIGS. 12 and 13 are denoted by like reference symbols, and their description will be omitted. Reference symbols 5*a* and 5*b* are circular waveguide rotary joints, and 6*a* and 6*b* are elevation shaft rotary mechanisms.

In the above-mentioned sixth embodiment, only the main reflection mirrors 1*a* and 1*b* and the sub-reflection mirrors 2*a* and 2*b* are so structured as to rotate about the elevation shaft without locating the elevation shaft rotary joint. However, in the eleventh embodiment, as shown in FIGS. 22 and 23, the circular waveguide rotary joint 5*a* is located between the circular waveguide 38*a* and the septum-type circularly polarized wave generator 20*a*, and the circular waveguide rotary joint 5*b* is located between the circular waveguide 38*b* and the septum-type circularly polarized wave generator 20*b*.

With the above structure, because the main reflection mirrors 1*a*, 1*b* and the sub-reflection mirrors 2*a*, 2*b* are integrated with the primary radiators 3*a* and 3*b* to enable the elevation shaft rotation, the mechanical strength of the main reflection mirrors 1*a* and 1*b* is enhanced, the height of from the main reflection mirrors 1*a* and 1*b* to the sub-reflection mirrors 2*a* and 2*b* can be so designed as to be small, and the antenna device can be further downsized without enlarging the power feeding circuit and without deteriorating the radiation characteristic.

Twelfth Embodiment

Figure 24:
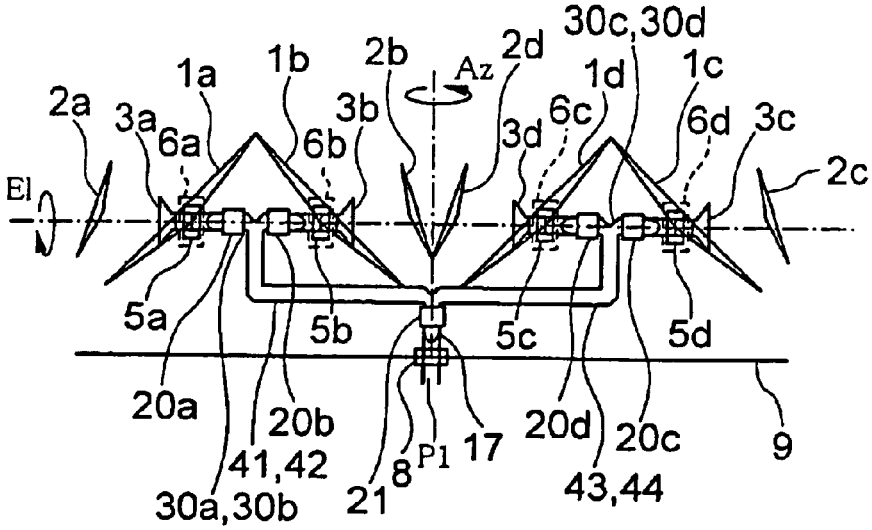
FIG. 24 is a side view showing an antenna device in accordance with a twelfth embodiment of the present invention.
Figure 25:
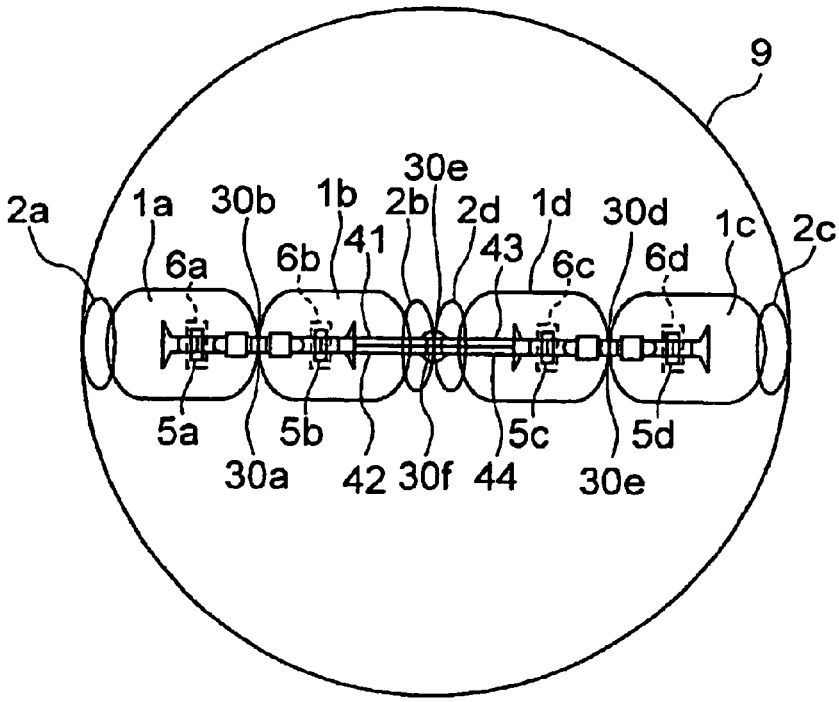
FIG. 25 is a top view showing the antenna device in accordance with the twelfth embodiment of the present invention.

FIG. 24 is a side view showing a mechanical drive reflecting mirror antenna device in accordance with a twelfth embodiment of the present invention, and FIG. 25 is a top view of the mechanical drive reflecting mirror antenna device.

In FIGS. 24 and 25, the same parts as those in the ninth embodiment shown in FIGS. 18 and 19 are denoted by like reference symbols, and their description will be omitted. Reference symbols 5*a* to 5*b* are circular waveguide rotary joints, and 6*a* to 6*b* are elevation shaft rotary mechanisms.

In the above-mentioned ninth embodiment, only the main reflection mirrors 1*a* to 1*d* and the sub-reflection mirrors 2*a* to 2*d* are so structured as to rotate about the elevation shaft without locating the elevation shaft rotary joint. However, in the twelfth embodiment, as shown in FIGS. 24 and 25, the circular waveguide rotary joint 5*a* is located between the circular waveguide 38*a* and the septum-type circularly polarized wave generator 20*a*, the circular waveguide rotary joint 5*b* is located between the circular waveguide 38*b* and the septum-type circularly polarized wave generator 20*b*, the circular waveguide rotary joint 5*c* is located between the circular waveguide 38*c* and the septum-type circularly polarized wave generator 20*c*, and the circular waveguide rotary joint 5*d* is located between the circular waveguide 38*d* and the septum-type circularly polarized wave generator 20*d*.

With the above structure, because the main reflection mirrors 1*a* to 1*d* and the sub-reflection mirrors 2*a* to 2*d* are integrated with the primary radiators 3*a* to 3*d* to enable the elevation shaft rotation, the mechanical strength of the main reflection mirrors 1*a* to 1*d* is enhanced, the height of from the main reflection mirrors 1*a* to 1*d* to the sub-reflection mirrors 2*a* to 2*d* can be so designed as to be smaller, and the antenna device can be still further downsized without enlarging the power feeding circuit and without deteriorating the radiation characteristic.

Thirteenth Embodiment

Figure 26:
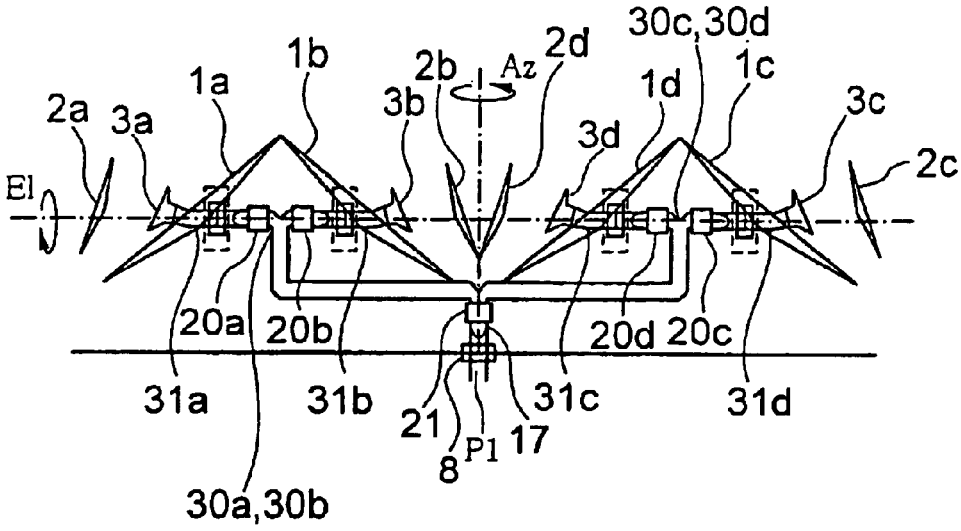
FIG. 26 is a side view showing an antenna device in accordance with a thirteenth embodiment of the present invention.
Figure 27:
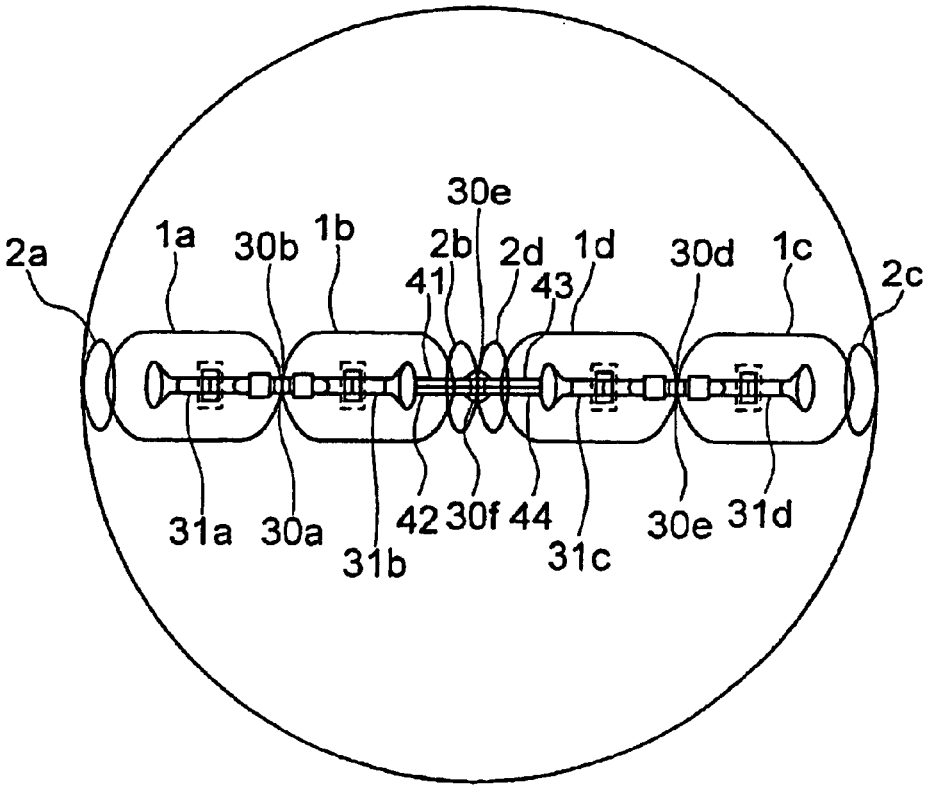
FIG. 27 is a top view showing the antenna device in accordance with the thirteenth embodiment of the present invention.
Figure 28:
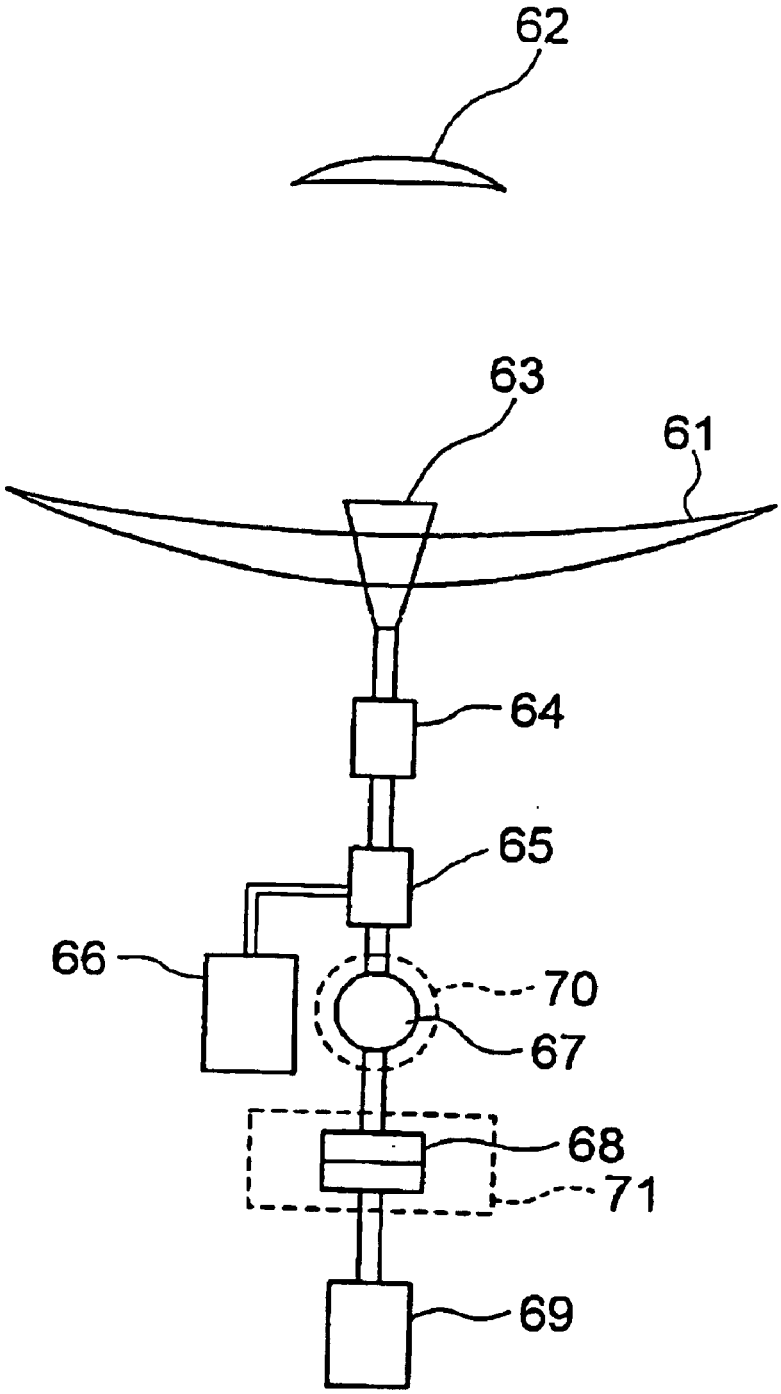
FIG. 28 (PRIOR ART)
FIG. 28 is a schematic structural view showing a conventional antenna device.

FIG. 26 is a side view showing a mechanical drive reflecting mirror antenna device in accordance with a thirteenth embodiment of the present invention, and FIG. 27 is a top view of the mechanical drive reflecting mirror antenna device.

In FIGS. 26 and 27, the same parts as those in the ninth embodiment shown in FIGS. 18 and 19 are denoted by like reference symbols, and their description will be omitted. Reference symbols 31*a* to 31*d* are circular waveguide bends.

In the above-mentioned ninth embodiment, the primary radiators 3*a* to 3*d* are so located as to be directed horizontally, but in the thirteenth embodiment, as shown in FIGS. 26 and 27, the primary radiators 3*a* to 3*d* are so located as to be directed obliquely upward and the circular waveguide bends 31*a* to 31*d* are employed instead of the circular waveguides 38*a* to 38*d*.

With the above structure, the height of from the main reflection mirrors 1*a* to 1*d* to the sub-reflection mirrors 2*a* to 2*d* can be so designed as to be smaller, and the antenna device can be expected to be still further downsized without enlarging the power feeding circuit and without deteriorating the radiation characteristic.

Finally, the advantages of the present invention will be recited as follows:

According to the present invention, there can be obtained such an advantage that the height of a portion of the antenna device upper than the azimuth shaft rotary mechanism can be appropriately reduced without deteriorating the electric characteristic, and there can be obtained the mechanical drive reflecting mirror antenna device that enables the downsizing, the low attitude and wide-angle scanning and is high in performance because the antenna portion and the rotary joint portion are connected to each other by the circular waveguides that have a plurality of 90-degree bendings and compensate the circularly polarized wave characteristic.

Also, there can be obtained such an advantage that the mechanical drive reflecting mirror antenna device is realized which is low in attitude and high in performance with the more excellent reflection characteristic since the reflection characteristic on the waveguide bend portion can be improved over the wide band with the use of the square-circle waveguide multi-step transformer or the square-circle waveguide taper as the square-circle waveguide transforming portion.

Further, there can be obtained such an advantage that the degree of freedom of the wiring design is made high, and the height of a portion of the antenna device upper than the azimuth shaft rotary mechanism can be designed so as to be appropriately small without deteriorating the electric characteristic because the antenna portion and the rotary joint portion are connected to each other by the rectangular waveguide.

Also, since the first and second rectangular waveguides are wired in parallel with each other with the same configuration and the third and fourth rectangular waveguides are wired in parallel with each other with the same configuration, the antenna device can be further downsized.

Further, there can be obtained such an advantage that there are two systems of the main reflection mirrors and the sub-reflection mirrors, and the antenna portion and the rotary joint portions are connected to each other by the rectangular waveguide with the results that the degree of freedom of the wiring design is made high, and the height of a portion of the antenna device upper than the azimuth shaft rotary mechanism can be so designed as to be smaller without deteriorating the electric characteristic.

Still further, since the first and second rectangular waveguides are wired in parallel with the same configuration, the third and fourth rectangular waveguides are wired in parallel with the same configuration, the fifth and sixth rectangular waveguides are wired in parallel with the same configuration, the seventh and eighth rectangular waveguides are wired in parallel with the same configuration, and the first and second waveguide T-junctions are disposed in parallel with the same configuration, the antenna device can be further downsized.

Yet still further, because the main reflection mirrors and the sub-reflection mirrors are integrated with the primary radiators to enable the elevation shaft rotation, the mechanical strength of the main reflection mirrors is enhanced, the height of from the main reflection mirrors to the sub-reflection mirrors can be so designed as to be small, and the antenna device can be further downsized without enlarging the power feeding circuit and without deteriorating the radiation characteristic.

Yet still further, there can be obtained such an advantage that there are two systems of the main reflection mirrors and the sub-reflection mirrors which are so located as to be directed obliquely downward or upward, and the antenna portion and the rotary joint portions are connected to each other by the rectangular waveguide with the results that the power feeding circuit can be downsized, the degree of freedom of the wiring design is made high, and the height of a portion of the antenna device upper than the azimuth shaft rotary mechanism can be so designed as to be smaller without deteriorating the electric characteristic.

Yet still further, since the circular waveguide bend is employed instead of the circular waveguide, the height of from the main reflection mirrors to the sub-reflection mirrors can be so designed as to be further smaller, and the antenna device can be still further downsized without enlarging the power feeding circuit and without deteriorating the radiation characteristic.

Yet still further, since the first and second waveguide T-junctions are disposed in parallel with the same configuration, the antenna device can be expected to be further downsized.

Yet still further, since the first circular waveguide rotary joint and the second circular waveguide rotary joint are so designed as to have the same rotary axis, and the third circular waveguide rotary joint is different in the direction of the rotary axis from the first and second circular waveguide rotary joints by substantially 90 degrees, the rotary mechanism can be commonly employed so that the antenna device can be downsized.

Yet still further, because the main reflection mirrors and the sub-reflection mirrors are integrated with the primary radiators to enable the elevation shaft rotation, the mechanical strength of the main reflection mirrors is enhanced, the height of from the main reflection mirrors to the sub-reflection mirrors can be so designed as to be smaller, and the antenna device can be further downsized without enlarging the power feeding circuit and without deteriorating the radiation characteristic.

Yet still further, there are four systems of the main reflection mirrors and the sub-reflection mirrors located obliquely downward or upward, and the antenna portion and the rotary joint portions are connected to each other by the rectangular waveguide with the effects that the height of from the main reflection mirror to the sub-reflection mirror can be so designed as to be further reduced, and the antenna deice can be expected to be further downsized without deteriorating the radiation characteristic.

Yet still further, the height of from the main reflection mirrors to the sub-reflection mirrors can be so designed as to be smaller, and the antenna device can be still further downsized without enlarging the power feeding circuit and without deteriorating the radiation characteristic.

Yet still further, since the first and second rectangular waveguides are wired in parallel with the same configuration, the third and fourth rectangular waveguides are wired in parallel with the same configuration, the first and second waveguide T-junctions are disposed in parallel with the same configuration, the third and fourth waveguide T-junctions are disposed in parallel with the same configuration, and the fifth and sixth waveguide T-junctions are disposed in parallel with the same configuration, the antenna device can be expected to be further downsized.

Yet still further, since the first to fourth circular waveguide rotary joints are so arranged as to provide the same rotary axis, and the fifth circular waveguide rotary joint is so arranged as to be different in the direction of the rotary axis from the above first to fourth circular waveguide rotary joints by substantially 90 degrees, the rotary mechanism can be commonly employed, and the antenna device can be downsized.

Yet still further, since the septum-type circularly polarized wave generator is employed as the orthogonal polarization diplexer, the downsized power feeding circuit can be structured.

Yet still further, since the orthomode transducer is employed as the orthogonal polarization diplexer, the excellent reflection characteristic can be obtained over the wide band.

Yet still further, there can be obtained such an advantage that there can be realized the mechanical drive reflecting mirror antenna device that is capable of receiving the signals of the right-handed and left-handed circularly polarized waves and transmitting the linearly polarized wave of an arbitrary angle and is low in attitude.

Yet still further, there can be obtained such an advantage that it is possible to appropriately reduce the height of a portion of the antenna device upper than the azimuth shaft rotary mechanism 9 without deterioration of the electric characteristic, and there can be obtained a mechanical drive reflecting mirror antenna device that can appropriately reduce the height of a portion of the antenna device upper than the mechanical drive reflecting mirror azimuth shaft rotary mechanism 9 which enables the downsizing, the low attitude and the wide-angle scanning and is high in performance, and can realize the downsizing, the low attitude and wide-angle scanning while keeping the low attitude of the entire antenna device with high performance because the antenna portion and the rotary joint portion are connected to each other by the circular waveguides 4 and 7 that have a plurality of 90-degree bendings and compensate the circularly polarized wave characteristic, and an adjustment that the opening configuration of the antenna is shaped into a substantial rectangle and a mirror surface adjustment that the opening distribution is made uniform are conducted on the antenna device.

INDUSTRIAL APPLICABILITY

As was described above, according to the present invention, there can be obtained such an advantage that the height of a portion of the antenna device upper than the azimuth shaft rotary mechanism can be appropriately reduced without deteriorating the electric characteristic, and there can be obtained a mechanical drive reflecting mirror antenna device that enables the downsizing, the low attitude and wide-angle scanning and is high in performance.

What is claimed is:

1. An antenna device comprising:

a plurality of reflecting mirrors;

at least one primary radiator;

a first circular waveguide which is connected to the primary radiator and has a plurality of bend portions;

a first circular waveguide rotary joint which is connected to the first circular waveguide;

a second circular waveguide which is connected to the first circular waveguide rotary joint and has a plurality of bend portions; and a second circular waveguide rotary joint which is connected to the second circular waveguide and is different in a direction of a rotary axis from said first circular waveguide rotary joint by substantially 90 degrees.

2. An antenna device comprising:

a plurality of reflecting mirrors;

at least one primary radiator;

a first square waveguide which is connected to the primary radiator and has a plurality of bend portions;

a first square-circle waveguide transforming portion which is connected to the first square waveguide;

a first circular waveguide rotary joint which is connected to the first square-circle waveguide transforming portion; a second square-circle waveguide transforming portion which is connected to the first circular waveguide rotary joint;

a second square waveguide which is connected to the second square-circle waveguide transforming portion and has a plurality of bend portions;

a third square-circle waveguide transforming portion which is connected to the second square waveguide; and a second circular waveguide rotary joint which is connected to the third square_circle waveguide transforming portion and is different in a direction of a rotary axis from said first circular waveguide rotary joint by substantially 90 degrees.

3. An antenna device according to claim 2, wherein square-circle waveguide multi-step transformers are used as said first to third square-circle waveguide transforming portions.

4. An antenna device according to claim 2, wherein square_circle waveguide tapers are used as said first to third square-circle waveguide transforming portions.

5. An antenna device according to claim 2, further comprising:

a waveguide orthomode transducer which is connected to said circular waveguide rotary joint and has first to fourth branching waveguides;

a first waveguide diplexer which is connected to the first and third branching waveguides of the polarization divider;

a second waveguide diplexer which is connected to the second and fourth branching waveguides of said polarization divider;

a first low-noise amplifier which is connected to said first waveguide diplexer;

a second low-noise amplifier which is connected to said second waveguide diplexer;

a first 90-degree hybrid circuit which is connected to said first and second low_noise amplifiers;

a second 90-degree hybrid circuit which is connected to said first and second waveguide diplexers;

a first high-power amplifier which is connected to the second 90-degree hybrid circuit;

a first variable phase shifter which is connected to the first high-power amplifier;

a second high-power amplifier which is connected to said second 90-degree hybrid circuit;

a second variable phase shifter which is connected to the second high-power amplifier; and a third 90-degree hybrid circuit which is connected to said first and second variable phase shifters.

6. An antenna device according to claim 2, further comprising:

a rotary mechanism that rotates said plurality of reflecting mirrors about an azimuth shaft and an elevation shaft which are orthogonal to each other, wherein each of said plurality of reflecting mirrors has a substantially rectangular opening which is slender in a direction of said elevation shaft and is subjected to a mirror surface adjustment so as to receive and reflect substantially all electromagnetic waves supplied from said primary radiators so that an antenna height is prevented from becoming high even when said plurality of reflecting mirrors rotate about the elevation shaft.

7. An antenna device comprising:

a plurality of reflecting mirrors;

at least one primary radiator;

a first orthogonal polarization diplexer which is connected to the primary radiator;

a second rectangular waveguide which is connected to said first orthogonal polarization diplexer;

a first rectangular waveguide which is connected to the first orthogonal polarization diplexer;

a second orthogonal polarization diplexer which is connected to said first and second rectangular waveguides;

a first circular waveguide rotary joint which is connected to the second orthogonal polarization diplexer;

a third orthogonal polarization diplexer which is connected to the first circular waveguide rotary joint;

a third rectangular waveguide which is connected to the third orthogonal polarization diplexer;

a fourth rectangular waveguide which is connected to said third orthogonal polarization diplexer;

a fourth orthogonal polarization diplexer which is connected to said third and fourth rectangular waveguides; and a second circular waveguide rotary joint which is connected to the fourth orthogonal polarization diplexer and is different in a direction of the rotary axis from said first circular waveguide rotary joint by substantially 90 degrees.

8. An antenna device according to claim 7, wherein said first and second rectangular waveguides are wired in parallel with the same configuration, and said third and fourth rectangular waveguides are wired in parallel with the same configuration.

9. An antenna device comprising:

a plurality of reflecting mirrors;

first and second primary radiators;

a first orthogonal polarization diplexer which is connected to said first primary radiator;

a first rectangular waveguide which is connected to the first orthogonal polarization diplexer;

a second rectangular waveguide which is connected to said first orthogonal polarization diplexer;

a second orthogonal polarization diplexer which is connected to said first and second rectangular waveguides;

a first circular waveguide rotary joint which is connected to the second orthogonal polarization diplexer;

a third orthogonal polarization diplexer which is connected to the first circular waveguide rotary joint; a third rectangular waveguide which is connected to the third orthogonal polarization diplexer;

a fourth rectangular waveguide which is connected to said third orthogonal polarization diplexer;

a fourth orthogonal polarization diplexer which is connected to said second primary radiator;

a fifth rectangular waveguide which is connected to the fourth orthogonal polarization diplexer; a sixth rectangular waveguide which is connected to said fourth orthogonal polarization diplexer;

a fifth orthogonal polarization diplexer which is connected to said fifth and sixth rectangular waveguides;

a second circular waveguide rotary joint which is connected to the fifth orthogonal polarization diplexer;

a sixth orthogonal polarization diplexer which is connected to the second circular waveguide rotary joint;

a seventh rectangular waveguide which is connected to the sixth orthogonal polarization diplexer;

an eighth rectangular waveguide which is connected to said sixth orthogonal polarization diplexer;

a first waveguide T-junction which is connected to said third and seventh rectangular waveguides;

a second waveguide T-junction which is connected to said fourth and eighth rectangular waveguides;

a seventh orthogonal polarization diplexer which is connected to said first and second waveguide T-junctions; and a third circular waveguide rotary joint which is connected to the seventh orthogonal polarization diplexer.

10. An antenna device according to claim 9, wherein said first and second rectangular waveguides are wired in parallel with the same configuration, said third and fourth rectangular waveguides are wired in parallel with the same configuration, said fifth and sixth rectangular waveguides are wired in parallel with the same configuration, said seventh and eighth rectangular waveguides are wired in parallel with the same configuration, and said first and second waveguide T-junctions are arranged in parallel with the same configuration.

11. An antenna device comprising:

a plurality of reflecting mirrors;

first and second primary radiators;

a first circular waveguide rotary joint which is connected to said first primary radiator;

a first orthogonal polarization diplexer which is connected to the first circular waveguide rotary joint;

a second circular waveguide rotary joint which is connected to said second primary radiator;

a second orthogonal polarization diplexer which is connected to the second circular waveguide rotary joint;

a first waveguide T-junction which is connected to said first and second orthogonal polarization diplexers;

a second waveguide T-junction which is connected to said first and second orthogonal polarization diplexers;

a third orthogonal polarization diplexer which is connected to said first and second waveguide T-junctions; and a third circular waveguide rotary joint which is connected to the third orthogonal polarization diplexer.

12. An antenna device comprising:

a plurality of reflecting mirrors;

first and second primary radiators;

a first orthogonal polarization diplexer which is connected to said first primary radiator;

a second orthogonal polarization diplexer which is connected to said second primary radiator;

a first waveguide T-junction which is connected to said first and second orthogonal polarization diplexers;

a second waveguide T-junction which is connected to said first and second orthogonal polarization diplexers;

a third orthogonal polarization diplexer which is connected to said first and second waveguide T-junctions; and a circular waveguide rotary joint which is connected to the third orthogonal polarization diplexer.

13. An antenna device comprising:

a plurality of reflecting mirrors;

first and second primary radiators;

a first circular waveguide bend which is connected to said first primary radiator;

a first circular waveguide rotary joint which is connected to the first circular waveguide bend;

a first orthogonal polarization diplexer which is connected to the first circular waveguide rotary joint;

a second circular waveguide bend which is connected to said second primary radiator;

a second circular waveguide rotary joint which is connected to the second circular waveguide bend;

a second orthogonal polarization diplexer which is connected to the second circular waveguide rotary joint;

a first waveguide T-junction which is connected to said first and second orthogonal polarization diplexers;

a second waveguide T-junction which is connected to said first and second orthogonal polarization diplexers;

a third orthogonal polarization diplexer which is connected to said first and second waveguide T-junctions; and a third circular waveguide rotary joint which is connected to the third orthogonal polarization diplexer.

14. An antenna device according to claim 13, wherein said first and second waveguide T-junctions are arranged in parallel with the same configuration.

15. An antenna device according to claim 14, wherein said first circular waveguide rotary joint and said second circular waveguide rotary joint are so arranged as to have the same rotary axis, and the third circular waveguide rotary joint is different in a direction of the rotary axis from said first and second circular waveguide rotary joints by substantially 90 degrees.

16. An antenna device according to claim 13, further comprising:

a waveguide orthomode transducer which is connected to said circular waveguide rotary joint and has first to fourth branching waveguides;

a first waveguide diplexer which is connected to the first and third branching waveguides of the polarization divider;

a second waveguide diplexer which is connected to the second and fourth branching waveguides of said polarization divider;

a first low-noise amplifier which is connected to said first waveguide diplexer;

a second low-noise amplifier which is connected to said second waveguide diplexer;

a first 90-degree hybrid circuit which is connected to said first and second low-noise amplifiers;

a second 90-degree hybrid circuit which is connected to said first and second waveguide diplexers;

a first high-power amplifier which is connected to the second 90-degree hybrid circuit;

a first variable phase shifter which is connected to the first high-power amplifier;

a second high-power amplifier which is connected to said second 90-degree hybrid circuit;

a second variable phase shifter which is connected to the second high-power amplifier; and a third 90-degree hybrid circuit which is connected to said first and second variable phase shifters.

17. An antenna device according to claim 13, further comprising:

a rotary mechanism that rotates said plurality of reflecting mirrors about an azimuth shaft and an elevation shaft which are orthogonal to each other, wherein each of said plurality of reflecting mirrors has a substantially rectangular opening which is slender in a direction of said elevation shaft and is subjected to a mirror surface adjustment so as to receive and reflect substantially all electromagnetic waves supplied from said primary radiators so that an antenna height is prevented from becoming high even when said plurality of reflecting mirrors rotate about the elevation shaft.

18. An antenna device comprising:

a plurality of reflecting mirrors; first to fourth primary radiators;

a first circular waveguide rotary joint which is connected to said first primary radiator;

a first orthogonal polarization diplexer which is connected to the first circular waveguide rotary joint;

a second circular waveguide rotary joint which is connected to said second primary radiator;

a second orthogonal polarization diplexer which is connected to the second circular waveguide rotary joint;

a first waveguide T-branching circuit which is connected to said first and second orthogonal polarization diplexers;

a second waveguide T-branching circuit which is connected to said first and second orthogonal polarization diplexers;

a third circular waveguide rotary joint which is connected to said third primary radiator;

a third orthogonal polarization diplexer which is connected to the third circular waveguide rotary joint;

a fourth circular waveguide rotary joint which is connected to said fourth primary radiator;

a fourth orthogonal polarization diplexer which is connected to the fourth circular waveguide rotary joint;

a third waveguide T-branching circuit which is connected to said third and fourth orthogonal polarization diplexers;

a fourth waveguide T-branching circuit which is connected to said third and fourth orthogonal polarization diplexers;

a first rectangular waveguide which is connected to said first waveguide T-junction; a second rectangular waveguide which is connected to said second waveguide T-junction;

a third rectangular waveguide which is connected to said third waveguide T-junction; a fourth rectangular waveguide which is connected to said fourth waveguide T-junction;

a fifth waveguide T-junction which is connected to said first and third rectangular waveguides;

a sixth waveguide T-junction which is connected to said second and fourth rectangular waveguides;

a fifth orthogonal polarization diplexer which is connected to said fifth and sixth waveguide T-junctions; and a fifth circular waveguide rotary joint which is connected to the fifth orthogonal polarization diplexer.

19. An antenna device comprising:

a plurality of reflecting mirrors;

first to fourth primary radiators; a first orthogonal polarization diplexer which is connected to said first primary radiator;

a second orthogonal polarization diplexer which is connected to said second primary radiator;

a first waveguide T-junction which is connected to said first and second orthogonal polarization diplexers;

a second waveguide T-junction which is connected to said first and second orthogonal polarization diplexers;

a third orthogonal polarization diplexer which is connected to said third primary radiator;

a fourth orthogonal polarization diplexer which is connected to said fourth primary radiator;

a third waveguide T-junction which is connected to said third and fourth orthogonal polarization diplexers;

a fourth waveguide T-junction which is connected to said third and fourth orthogonal polarization diplexers;

a first rectangular waveguide which is connected to said first waveguide T-junction;

a second rectangular waveguide which is connected to said second waveguide T-junction;

a third rectangular waveguide which is connected to said third waveguide T-junction;

a fourth rectangular waveguide which is connected to said fourth waveguide T-junction;

a fifth waveguide T-junction which is connected to said first and third rectangular waveguides;

a sixth waveguide T-junction which is connected to said second and fourth rectangular waveguides;

a fifth orthogonal polarization diplexer which is connected to said fifth and sixth waveguide T-junctions; and a circular waveguide rotary joint which is connected to the fifth orthogonal polarization diplexer.

20. An antenna device comprising:

a plurality of reflecting mirrors; first to fourth primary radiators;

a first circular waveguide bend which is connected to said first primary radiator;

a first circular waveguide rotary joint which is connected to the first circular waveguide bend;

a first orthogonal polarization diplexer which is connected to the first circular waveguide rotary joint;

a second circular waveguide bend which is connected to said second primary radiator; a second circular waveguide rotary joint which is connected to the second circular waveguide bend;

a second orthogonal polarization diplexer which is connected to the second circular waveguide rotary joint;

a first waveguide T-branching circuit which is connected to said first and second orthogonal polarization diplexers;

a second waveguide T-branching circuit which is connected to said first and second orthogonal polarization diplexers;

a third circular waveguide bend which is connected to said third primary radiator; a third circular waveguide rotary joint which is connected to the third circular waveguide bend;

a third orthogonal polarization diplexer which is connected to the third circular waveguide rotary joint;

a fourth circular waveguide bend which is connected to said fourth primary radiator;

a fourth circular waveguide rotary joint which is connected to the fourth circular waveguide bend;

a fourth orthogonal polarization diplexer which is connected to the fourth circular waveguide rotary joint;

a third waveguide T-branching circuit which is connected to said third and fourth orthogonal polarization diplexers;

a fourth waveguide T-branching circuit which is connected to said third and fourth orthogonal polarization diplexers;

a first rectangular waveguide which is connected to said first waveguide T-junction;

a second rectangular waveguide which is connected to said second waveguide T-junction; a third rectangular waveguide which is connected to said third waveguide T-junction;

a fourth rectangular waveguide which is connected to said fourth waveguide T-junction; a fifth waveguide T-junction which is connected to said first and third rectangular waveguides;

a sixth waveguide T-junction which is connected to said second and fourth rectangular waveguides;

a fifth orthogonal polarization diplexer which as connected to said fifth and sixth waveguide T-junctions; and a fifth circular waveguide rotary joint which is connected to the fifth orthogonal polarization diplexer.

21. An antenna device according to claim 20, wherein said first and second rectangular waveguides are wired in parallel with the same configuration, said third and fourth rectangular waveguides are wired in parallel with the same configuration, the first and second waveguide T-junctions are arranged in parallel with the same configuration, the third and fourth waveguide T-junctions are arranged in parallel with the same configuration, and the fifth and sixth waveguide T-junctions are arranged in parallel with the same configuration.

22. An antenna device according to claim 21, wherein said first to fourth circular waveguide rotary joints are so arranged as to have the same rotary axis, and the fifth circular waveguide rotary joint is different in a direction of the rotary axis from said first to fourth circular waveguide rotary joints by substantially 90 degrees.

23. An antenna device according to claim 22, wherein a septum type polarizer is used as said orthogonal polarization diplexer.

24. An antenna device according to claim 22, wherein an orthomode transducer is used as said orthogonal polarization diplexer.

25. An antenna device according to claim 20, further comprising:

a waveguide orthomode transducer which is connected to said circular waveguide rotary joint and has first to fourth branching waveguides;

a first waveguide diplexer which is connected to the first and third branching waveguides of the polarization divider;

a second waveguide diplexer which is connected to the second and fourth branching waveguides of said polarization divider;

a first low-noise amplifier which is connected to said first waveguide diplexer;

a second low-noise amplifier which is connected to said second waveguide diplexer;

a first 90-degree hybrid circuit which is connected to said first and second low-noise amplifiers;

a second 90-degree hybrid circuit which is connected to said first and second waveguide diplexers;

a first high-power amplifier which is connected to the second 90-degree hybrid circuit;

a first variable phase shifter which is connected to the first high-power amplifier;

a second high-power amplifier which is connected to said second 90-degree hybrid circuit;

a second variable phase shifter which is connected to the second high-power amplifier; and a third 90-degree hybrid circuit which is connected to said first and second variable phase shifters.

26. An antenna device according to claim 20, further comprising:

a rotary mechanism that rotates said plurality of reflecting mirrors about an azimuth shaft and an elevation shaft which are orthogonal to each other, wherein each of said plurality of reflecting mirrors has a substantially rectangular opening which is slender in a direction of said elevation shaft and is subjected to a mirror surface adjustment so as to receive and reflect substantially all electromagnetic waves supplied from said primary radiators so that an antenna height is prevented from becoming high even when said plurality of reflecting mirrors rotate about the elevation shaft.

27. An antenna comprising:

a reflecting mirror for receiving a received signal;

a primary radiator for transmitting therethrough a transmission signal;

a first waveguide being connected to the primary radiator, the first waveguide having a plurality of bend portions;

a first rotary joint being connected to the first waveguide, the first rotary joint providing elevation adjustment for the antenna;

a second waveguide being connected to the first rotary joint, the second waveguide having a plurality of bend portions; and a second rotary joint being connected to the second waveguide, the second rotary joint providing azimuth adjustment for the antenna, wherein the plurality of bend portions of the first waveguide and second waveguide are provided such that a number of bend portions in a vertical plane is the same as a number of bend portions in a horizontal plane.

28. The antenna according to claim 27, wherein the first wave guide, the first rotary joint, the second wave guide, and the second rotary joint collectively forming a waveguide to channel the received signal and the transmission signal.

29. A waveguide path connected between a primary radiator of an antenna mirror and a receiver/transmitter for channeling an electromagnetic field therethrough, said waveguide path having first and second rotary joints provided therein to provide respective elevating and azimuth adjustments to said antenna mirror, wherein the primary radiator is provided on a lower end of the antenna mirror in a reception direction, wherein either one of the first or second rotary joints is provided below the primary radiator in the reception direction, and wherein either one of the first or second rotary joints is provided above the primary radiator in the reception direction.

30. An antenna device comprising:

a plurality of reflecting mirrors;

at least one primary radiator;

a first circular waveguide which is connected to the primary radiator and has a plurality of bend portions;

a first circular waveguide rotary joint which is connected to the first circular waveguide and allows the first circular waveguide to rotate about a first axis;

a second circular waveguide which is connected to the first circular waveguide rotary joint and has a plurality of bend portions; and a second circular waveguide rotary joint which is connected to the second circular waveguide and allows the second circular waveguide to rotate about a second axis, wherein the angle between the first axis and the second axis is substantially 90 degrees.

31. An antenna device comprising:

a plurality of reflecting mirrors;

at least one primary radiator;

a first circular waveguide which is connected to the primary radiator and has a plurality of bend portions;

a first circular waveguide rotary joint which is connected to the first circular waveguide and allows the first circular waveguide to rotate within a first plane;

a second circular waveguide which is connected to the first circular waveguide rotary joint and has a plurality of bend portions; and a second circular waveguide rotary joint which is connected to the second circular waveguide and allows the second circular waveguide to rotate within a second plane, wherein the angle between the first plane and the second plane is substantially 90 degrees.

* * * * *